US005573233A

United States Patent [19]

Hirai et al.

[11] Patent Number: 5,573,233

[45] Date of Patent: Nov. 12, 1996

[54] SHEET POST-PROCESSING APPARATUS WITH MALFUNCTION OPERATION

[75] Inventors: Katsuaki Hirai; Yoshifumi Takehara, both of Yokohama, Japan

[73] Assignee: Canon Kabushiki Kaisha, Tokyo, Japan

[21] Appl. No.: 437,678

[22] Filed: May 9, 1995

[30] Foreign Application Priority Data

May 10, 1994 [JP] Japan ..... 6-121763

[51] Int. Cl.[6] ..... B65H 31/00; G03G 15/00

[52] U.S. Cl. ..... 270/58.08; 270/58.01; 399/130

[58] Field of Search ..... 270/53; 355/324

[56] References Cited

U.S. PATENT DOCUMENTS

| | | | |
|---|---|---|---|
| 4,244,564 | 1/1981 | Brown | 270/53 |
| 4,328,963 | 5/1982 | DuBois et al. . | |
| 4,343,463 | 8/1982 | Lawrence . | |
| 4,421,264 | 12/1983 | Arter et al. | 355/324 X |
| 4,466,608 | 8/1984 | DuBois et al. . | |
| 5,187,534 | 2/1993 | Iwata et al. | 270/53 X |
| 5,190,274 | 3/1993 | Kamamoto et al. | 270/53 |
| 5,230,457 | 7/1993 | Hiroi et al. | 355/324 X |
| 5,263,697 | 11/1993 | Yamazaki et al. | 270/53 |
| 5,285,249 | 2/1994 | Mahoney | 270/53 X |
| 5,384,634 | 1/1995 | Takehara et al. | 270/53 X |
| 5,417,417 | 5/1995 | Takehara et al. . | |

*Primary Examiner*—John E. Ryznic

*Attorney, Agent, or Firm*—Fitzpatrick, Cella, Harper & Scinto

[57] ABSTRACT

A sheet post processing apparatus includes a plurality of movable a post-processing device for effecting a predetermined post-processing for a set of sheets; malfunction detector for detecting malfunction for each of the post-processing device; a controller, responsive to the malfunction detector, for controlling the post-processing device to place, at a position where the post-processing device is to be placed if the malfunction did not occur, another one of the post-processing device free of the malfunction.

11 Claims, 24 Drawing Sheets

SHEET POST-PROCESSING APPARATUS WITH MALFUNCTION OPERATION

FIELD OF THE INVENTION AND RELATED ART

The present invention relates to a post-image formation sheet processing apparatus, more specifically, such a post-image formation sheet processing apparatus that sorts material in the form of a sheet discharged from an image forming apparatus such as a copying machine, printer, or the like, and then processes (for example, binding, punching holes) the sorted sheets.

As for a typical post-image formation sheet processing apparatus which sorts and processes the sheets discharged from the image forming apparatus, a moving-bin type sorter is well-known, which sorts the sheets into a plurality of bins.

FIG. 23 illustrates an example of the conventional moving-bin type sorter as the post-image formation sheet processing apparatus.

A sheet S discharged from the image forming apparatus is led to a predetermined sheet discharging portion (discharging roller pair 201) through a sheet delivery path 200.

A bin unit 202 comprising a plurality of bins Bl–Bn vertically moves following a guide rail 203 of the sorter main assembly 205, and the sheet S discharged from the sheet discharging portion is accumulated and stored into a bin B (bin B1 in FIG. 23) standing still at a location corresponding to the sheet discharging portion. In other words, the bin unit 202 moves up or down and stops when the bin B aligns with the sheet discharging portion and then, sheets S are sequentially accumulated and stored in the stationary bin B.

After a predetermined number of sheets are sorted into each of the bins B1–Bn of the bin unit 202, the bin unit 202 is moved up or down, and during this movement, a set of sheet (sheet set) SA accumulated and stored in each of the bin B1–Bn is sequentially processed.

In the case of this sorter, a single stapler 204 (post-image formation processing means) is provided to staple the sorted sheet set at a predetermined point (or points). This stapler is such a stapler that binds the sheet set SA by striking a staple (or staples) into the sheet set SA in the bin B standing still at the position corresponding to the sheet discharging portion. In this case, as the bin B stops at the position corresponding to the sheet discharging portion, the stapler 204 advances from a retractive position (illustrated with a dotted line) to an operating position (illustrated with a solid line) to strike the staple into the sheet set SA.

When the stapler 204 advances to the operating position where it strikes the staple into the sheet set SA, it must invade into the sheet accumulating area across the sheet entrance side edges of the bin B. However, sheet entrance side bin intervals X1 and X2 between a bin which is going to be stopped at the position corresponding to the sheet discharging portion, and the adjacent bins directly above and below, are expanded by an unillustrated lead cam or the like as the bin unit 202 is shifted up or down; therefore, the stapler 204 can advance to the operating position with no problem. Further, since the aforementioned bin interval X1 is expanded as the bin unit 202 is shifted up or down, the sheet S can be preferably discharged from the sheet discharging portion into the bin B.

As for the art of expanding the sheet entrance side bin intervals X1 and X2 between the bin to be stopped at the position corresponding to the sheet discharging portion, and the adjacent bins directly above and below as the bin unit 202 is shifted up or down, it is disclosed in, for example, U.S. Pat. Nos. 4,328,963; 4,466,608; and 4,343,463.

Further, in the case of this sorter, a single stapler 204 is moved only in the sheet delivery direction to bind the sheet set SA; therefore, the type of sheet binding is limited to only one type, whereas some of the conventional sorters allow an operator to select a desired type of binding among several sheet set binding types, as shown in FIG. 24.

With an arrangement as shown in FIG. 24, it is possible to bind the sheet set SA in the bin B in three different ways: (1) to bind the sheet set SA with the stapler 204 set at a position (A); (2) to bind it with the stapler 204 set at a position and a position (C); and (3) bind it with the stapler 204 set at the position (C).

FIG. 25(*a*) shows the sheet set SA bound by the method (1); FIG. 25(*b*), the sheet set SA bound by the method (2): and FIG. 25(*c*) shows the sheet set SA bound by the method (3).

The binding method (3) is employed when the sheet set SA is oriented so as for referential symbols A and B to be aligned in the sheet delivery direction.

FIG. 26 illustrates examples for carrying out the aforementioned binding methods (1)–(3).

In FIG. 26(*a*), only a single stapler 204 is employed to allow the operator to select any one of the methods (1)–(3). More specifically, when the method (1) is selected, the sheet set SA is bound with the stapler. 204 set at the position (A). When the method (2) is selected, the sheet set SA is first bound with the stapler 204 set at the position (B), and is bound again with the stapler 204 set this time at the position (C). When the method (3) is selected, the sheet set SA is bound with the stapler 204 set at the position (C).

In this case, the stapler 204 is movable in the direction (direction of an arrow) perpendicular to the sheet delivery direction, wherein when the method (2) or (3) is chosen, the stapler 204 at the position (A), the home position is moved to the positions (B) and (C).

In the case of the structure shown in FIG. 26(*a*), only a single stapler 204 is necessary to offer a selection among the methods (1)–(3); therefore, it enjoys such an advantage that it can be manufactured with lower cost than the structure shown in FIG. 26(*b*), which will be described later, or a like advantage.

In the case of the structure illustrated in FIG. 26(*b*), two staplers 204A and 204B are employed so that the aforementioned three selections of the binding methods can be offered. In this case, one of the staplers, 204A, is movable in the direction (arrow direction) perpendicular to the sheet delivery direction, whereas the other stapler, 204B, is not movable in the same direction.

More specifically, when the method (1) is selected, the sheet set SA is bound with the stapler 204A located at the position (A), the home position. When the method (2) is chosen, the sheet set SA is bound with the stapler 204A having been moved to the position (B), and the stapler 204A located at the position (C). When the method (3) is used, the sheet set SA is bound with the stapler 204B located at the position (C).

In the case of the structure illustrated FIG. 26(*b*), when the sheet set SA is bound using the binding method (2), the binding operation can be carried out using two staplers 204A and 204B at the same time; therefore, it enjoys such an advantage that the processing speed can be increased compared to the structure shown in FIG. 26(*a*), or a like advantage.

A sorter comprising a stapler as the post-image formation processing apparatus be equipped so as to detect the out-of-staple condition or staple jam condition and warn the operator of the condition. However, in the case of the structure shown in FIG. 26(*b*), in which two staplers 204A and 204B are employed, an arrangement must be made so that it is possible to find out which stapler is out of staples or in which stapler the staple jam has occurred.

In an example shown in FIG. 27, a pair of out-of-staple display portions 206A and 206B, and a pair of staple jam display portions 207A and 207B for the pair of staplers 204A and 204B, respectively, are provided on the top surface of the sorter main assembly 205..

When the out-of-staples condition occurs in the stapler 204A (stapler 1) in operation, the display portion 206*a* flashes, and when the staple jam occurs, the staple jam display portion 207A flashes. Further, when the out-of-staple condition occurs in the stapler 204B (stapler 2) in operation, the out-of-staple display portion 206B flashes, and when the staple jam occurs the staple jam display portion 207B flashes.

However, in the case of the structure such as the example illustrated in FIG. 26(*a*), in which a single stapler is employed to offer the selections of the binding methods (1)–(3), the on-going processing operation must be ended the moment the stapler 204 runs out of staples or is jammed with a staple.

Further, in the case of the structure as shown in FIG. 26(*b*), in which the stapler 204A movable in the direction perpendicular to the sheet delivery direction, and the stapler 204B movable in the same direction as the stapler 204A are employed to offer the aforementioned binding methods (1)–(3), when one of the staplers 204A or 204B runs out of staples or is jammed with a staple, the on-going Job must be ended at the moment, or must be continued using the remaining single stapler, thereby improperly binding the sheet set SA.

In other words, when the stapler 204A runs out of staples or is jammed with a staple during a stapling operation using the stapling method (1), is impossible to continue binding the sheet set therefore, the job is ended, whereas when the same occurs when the method (2) is employed, the sheet set SA is bound with only the stapler 204B.

Further, referring to FIG. 27, in case the out-of-staples display portions 206A and 206B and staple jam display portions 207A and 207B for the stapler 204A (stapler 1) and 204B (stapler 2), respectively, are disposed at substantially the same area of the sorter main assembly 205, when one of the display portions (out-of-staples display portions 206A and 206B, staple jam display portions 207A and 207B) flashes, it is rather difficult for the operator to tell which stapler has run out of staples or has been jammed with a staple. This is the problem.

SUMMARY OF THE INVENTION

The present invention was made in consideration of the above described concern, and its object is to provide a post-image formation sheet processing apparatus, in which even when an anomaly occurs to one of the plurality of the post-image formation processing means, an intended post-image formation processing operation can be carried out by the other post-image formation processing means.

Another object of the present invention is to provide a post-image formation sheet processing apparatus capable of displaying to which means the malfunction has occurred, so that, when a malfunction occurs to any one of the plurality of post-image formation processing means, an operator can easily identify the malfunctioning one.

According to an aspect of the present invention, a sheet post processing apparatus comprising: a plurality of movable post-processing means for effecting a predetermined post-processing for a set of sheets; malfunction detecting means for detecting malfunction for each of the post-processing means; control means, responsive to the malfunction detecting means, for controlling the post-processing means to place, at a position where the post-processing means is to be placed if the malfunction did not occur, another one of the post-processing means free of the malfunction, According to another aspect of the present invention, there is provided a sheet post processing apparatus comprising: a plurality of movable post-processing means for effecting a predetermined post-processing for a set of sheets; malfunction detecting means for detecting malfunction for each of the post-processing means; and common malfunction displaying means for displaying the malfunction detected by the detecting means, malfunction post-processing means displaying means for individually displaying the malfunction post-processing means detected by the detecting means, and a second control means for operating the malfunction displaying means and the malfunction post-processing means displaying means, wherein the malfunction displaying means is provided outside a main assembly of the apparatus, and malfunction post-processing means displaying means is provided in the apparatus.

As an improvement, the malfunction displaying means is provided outside a main assembly of the apparatus, and malfunction post-processing means displaying means is provided in the apparatus.

With such an arrangement, even when a malfunction occurs to the post-image formation processing means assigned to process the sheet set after the image formation, the on-going job can be continued with no interruption.

Also, in the post-image formation sheet processing apparatus comprising the aforementioned structure, when any one of the post-image formation means malfunctions, the malfunction displaying means, which is shared by the plurality of the post-image formation processing means and displays the malfunction of the processing means, and the malfunctioning post-image formation processing means displaying means for displaying individually the malfunctioning post-image formation processing means, are activated.

With such an arrangement, the operator can easily identify what kind of malfunction has occurred to which post-image formation processing means, allowing the operator to take a quick action to dissolve the malfunction.

These and other objects, features and advantages of the present invention will become more apparent upon a consideration of the following descriptions of the preferred embodiments of the present invention taken in conjunction with the accompanying drawings.

DESCRIPTION OF THE PREFERRED EMBODIMENTS

Figure 1:
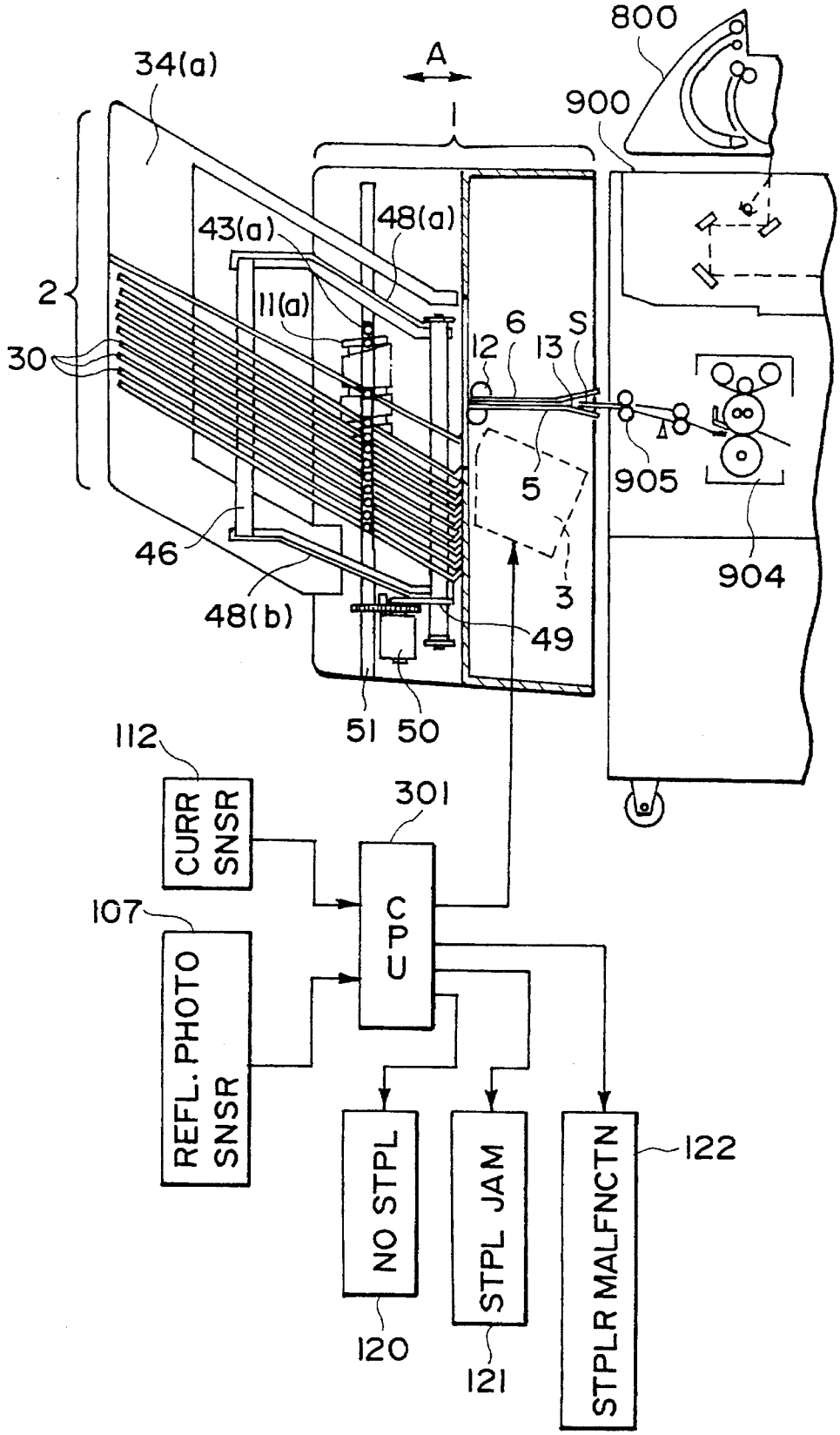
FIG. 1 is a vertical sectional view of the general structure of a moving-bin type sorter as the post-image formation sheet processing apparatus in accordance with the first and second inventions.

Hereinafter, the embodiments of the present invention will be described referring to the drawings.

Figure 2:
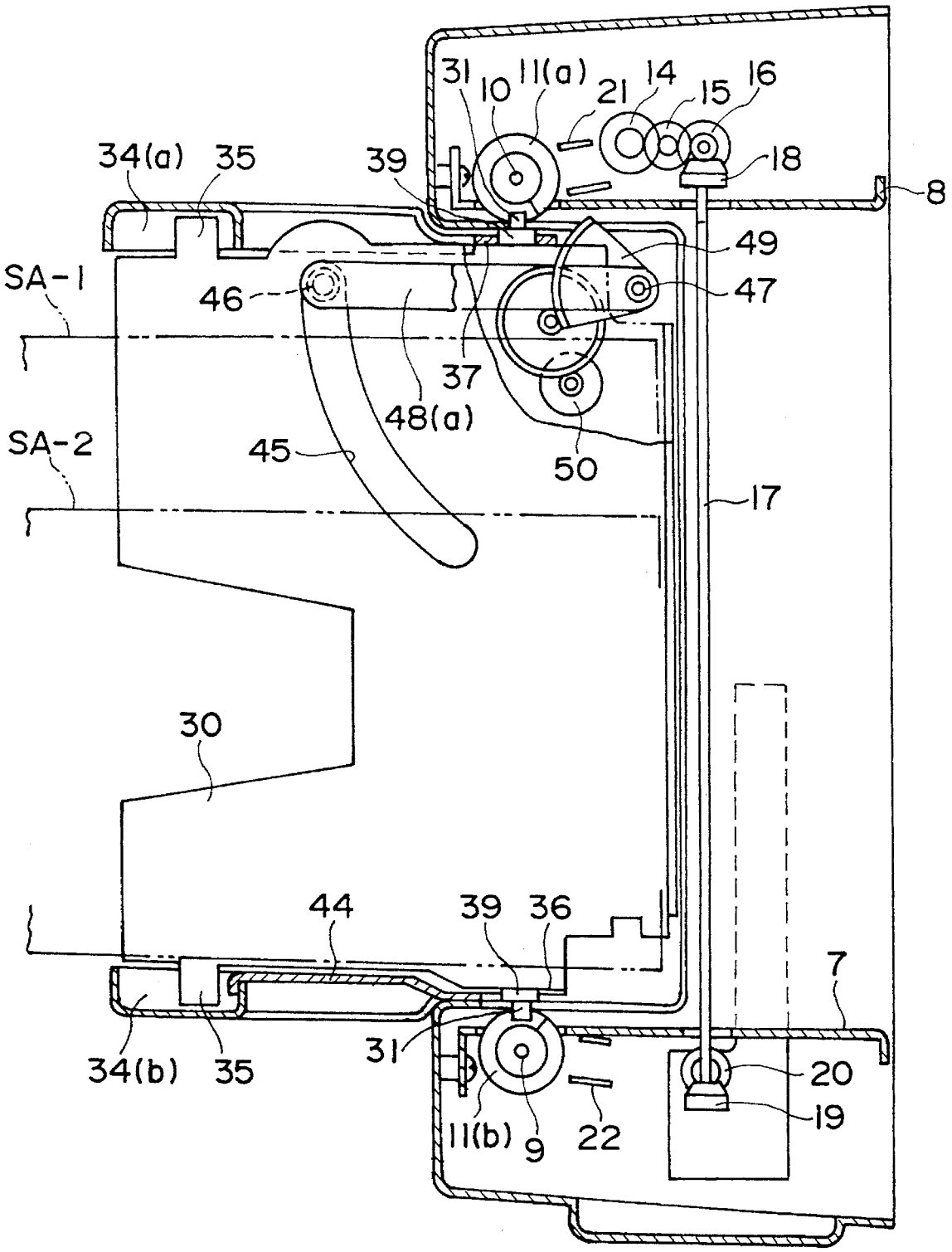
FIG. 2 is a horizontal sectional view of the moving-bin type sorter illustrated in FIG. 1.

FIG. 1 is a vertical section of the overall structure of the moving-bin type sorter as the post-image formation sheet processing apparatus in accordance with the present invention, and FIG. 2 is a horizontal section of the overall structure of the same sorter.

This sorter is connected to an image forming apparatus (copying machine) 9 provided with an automatic original feeding apparatus 800. It sorts the sheets S discharged from the image forming apparatus 900 after the image formation, and binds the sorted sheet sets with a staple or staples.

This sorter comprises three units: a main unit 1, a bin unit 2 and a stapling unit 3.

Figure 6:
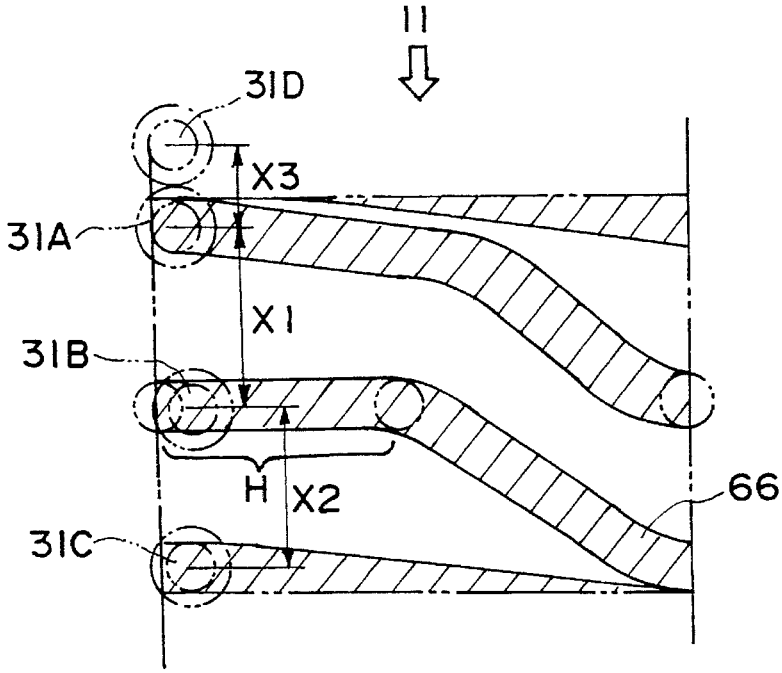
FIG. 6 is a line drawing of the structure of a lead cam, which vertically moves the bin unit up or down.

The main unit 1 comprises: a frame 4; a bottom guide 5 integrated with a bottom guide; a top guide disposed so as to correspond to the bottom guide 5; a front plate 7 and a rear plate 8, which are attached to the front and rear recessed portions of the frame 4, respectively: a front shaft 9 and a rear shaft 10 mounted on the front and rear plates, respectively; a lead cam 11*a* and a lead cam 11*b* mounted rotatively on the shafts 9 and 10, respectively, wherein the structure of this lead cams 11*a* and 11*b* are shown in FIG. 6; and a sheet delivery roller pair 11 mounted on the front and rear plate 7 and 8. Further, adjacent to the sheet discharging portion of a sheet delivery path 13, an unillustrated sheet sensor is provided, which consists of a photosensor and an actuator and detects the presence or absence of the sheet S. The time at which the sheet S passes and the sheet interval can be measured by the sheet sensor, and the thus obtained detection signals are sent to a microcomputer within the main unit 1 of the sorter.

Figure 3:
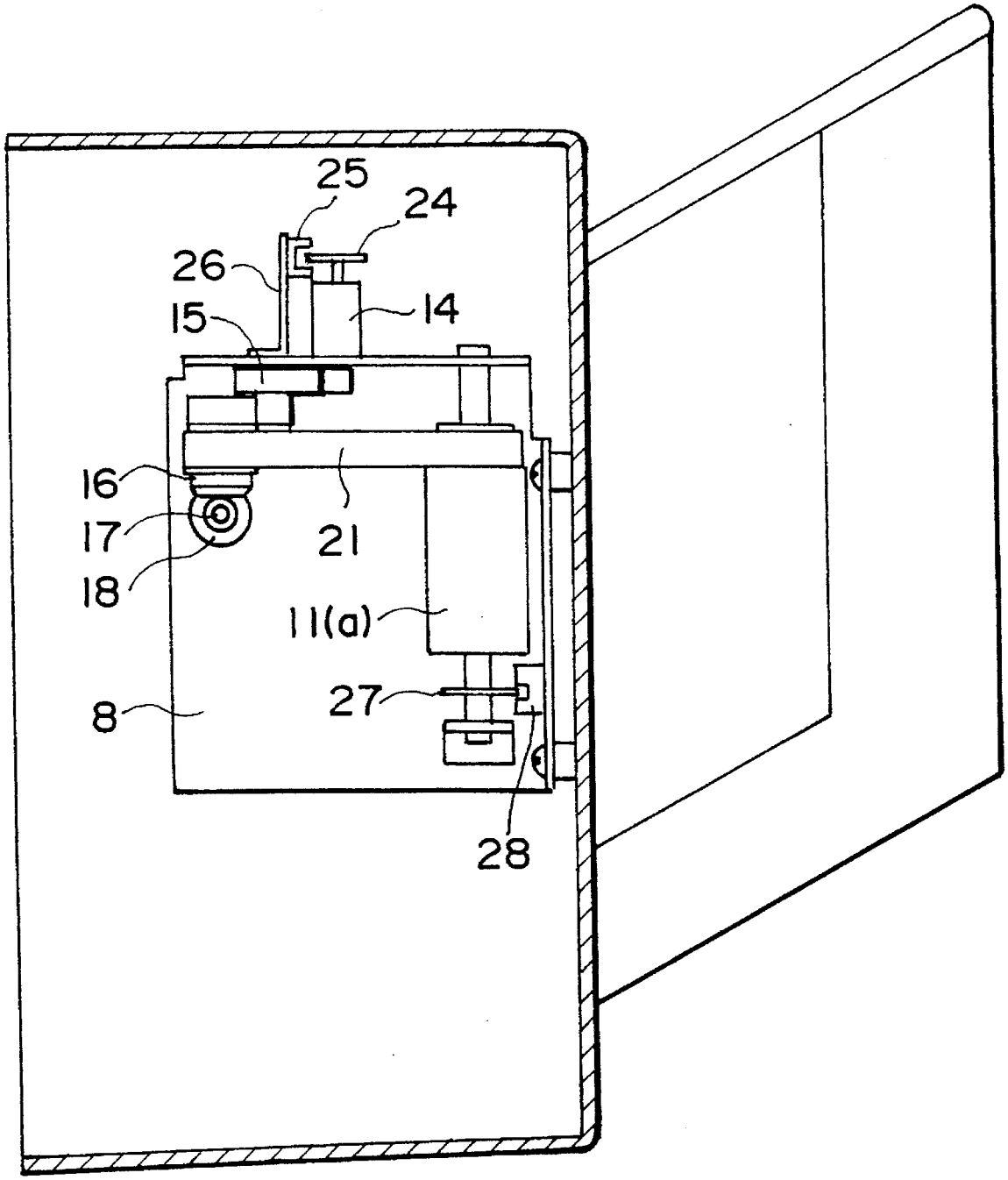
FIG. 3 is a vertical section of the structure of the bin unit of the moving-bin type sorter illustrated in FIG. 1.

Referring to FIGS. 2 and 3, on the rear plate 8, a reversible shift motor 14 is mounted. The driving force of the motor 14 is transmitted through a gear train 15 to a bevel gear 16 formed integrally with a pulley, and then, from the bevel gear 16 to the lead cam 11(*a*) through a belt 21. The bevel gear 16 is engaged with a bevel gear 18 fixed to one end of a through shaft 17, to the other end of which a bevel gear 19 is fixed, and the bevel gear 19 is engaged with a bevel gear 20 formed integrally with a pulley. The bevel gear 20 is connected to a pulley formed integrally with the lead cam 11(B), by a belt 22.

With the driving force transmission system constructed as described above, as the shift motor 14 is rotated forward the lead cam 11 also is rotated forward. The number of the shift motor 14 revolutions, that is, the number of the lead cam 11 revolutions, is read with a combination of a clocking circular plate 24 fixed to the output shaft of the shift motor 14 and a photointerruptor 25 supported on the rear plate 8 using a sensor holder 26; therefore, the number of lead cam 11 revolutions can be accurately controlled with an unillustrated shift motor controlling circuit in the main unit 1 of the sorter. Further, a flag 27 for detecting the lead cam 11 position is mounted on the shaft of the lead cam 11(*a*), at the bottom portion, and a photosensor for reading the flag 27 is fixed to the rear plate 8. Referring to FIG. 6, a spiral cam groove 66 is provided with a horizontal portion H, which extends approximately 180°, and the flag 27 is in the form of a fan having a 180° spread so that it can detect the horizontal portion H.

Next, the bin unit 2 will be described.

Figure 4:
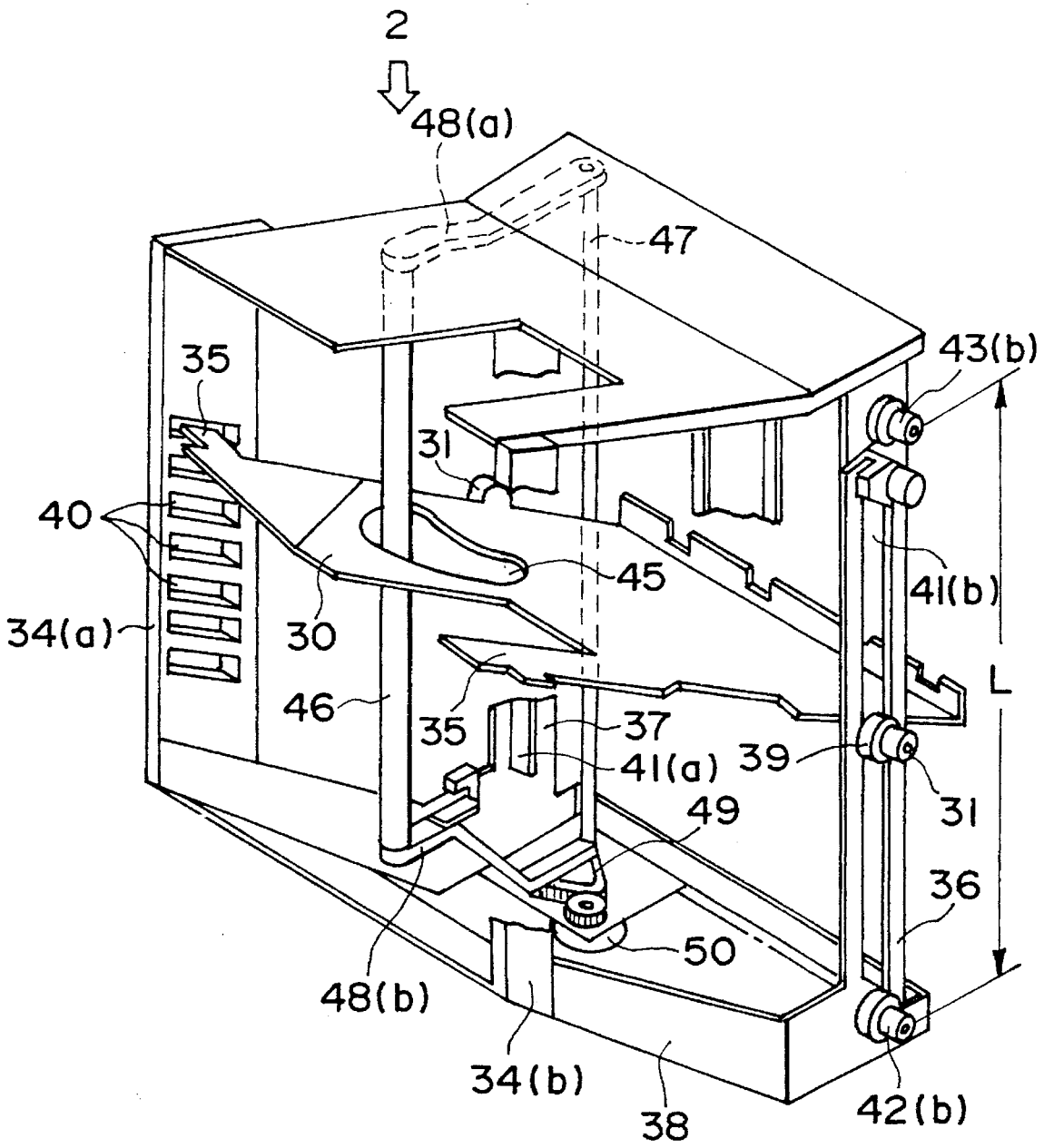
FIG. 4 is a perspective view of the structure of the same moving-bin type sorter.

The bin unit 2 comprises a plurality of bins 30 (means for accumulating and storing the sheets) for accumulating and storing the sheet S discharged from the sheet delivery roller pair 12. Referring to FIGS. 2 and 4, each bin 30 is provided with: a pair of trunnions 31 and 31, which are attached to the corresponding lateral edges of the bin 30, at the base side, and are engaged with the cam surfaces of the lead cams 11(*a*) and 11(*b*), respectively; and tongues (projections) 35 and 35, which project from the lateral edges of the bin, from the leading end side relative to the sheet delivery direction, and engage with separator 34(*a*) and 34(*b*), respectively. Each of the bins 30 is supported by a bin frame 38. The bin frame 38 is integrally constituted of: a front and a rear supporting plate 36 and 37 provided with a left and right guides for the left and right trunnions 31 and 31, respectively; and the separators 34(*a*) and 34(*b*).

The bin 30 is provided with a supporting portion 39, which has a predetermined diameter and is in line with the shaft of the trunnion 31. When the trunnion 31 is not engaged with the lead cam 11, the bin interval between the adjacent bins 30 and 30 remain the same as the height of the supporting portions 39, and the width of grooves 40 cut on the separator 34(*a*) and 34(*b*) with a predetermined pitch.

Further, at the bottom end portions of the trunnion guides 41(*a*) and 41(*b*) of the supporting plates 36 and 37, bottom guide pins 42(*a*) and 42(*b*) are fixed by crimping (the other side is not illustrated), and a predetermined distance L above the bottom guide pins 42, top guide pins 43(*a*) and 43(*b*) are fixed with a vise (the other side is not illustrated).

The mounting surface of the top guide pin 43 is given a square notch, being thereby allowed to slide along the groove: therefore, the distance L can be adjusted by displacing the position where the top guide pin 43 is fixed with the vise. With this adjustment of the distance L the pickup end portion of the lead cam 11 is prevented from hitting the mid section of the trunnion 31 when the pickup end portion of the lead cam 11 scoops up the trunnion 31, so that the former can smoothly scoop up the latter.

Further, on the front side of the bin frame 38, an alignment reference member 44 is fixed. Also, an aligning rod 46 is put through all of the arc-shaped cutaway portions 46 cut in each bin 30. The aligning rod 46 is supported with top and bottom arms 48(*a*) and 48(*b*), which are oscillatable about an axial shaft 47.

Figure 5:
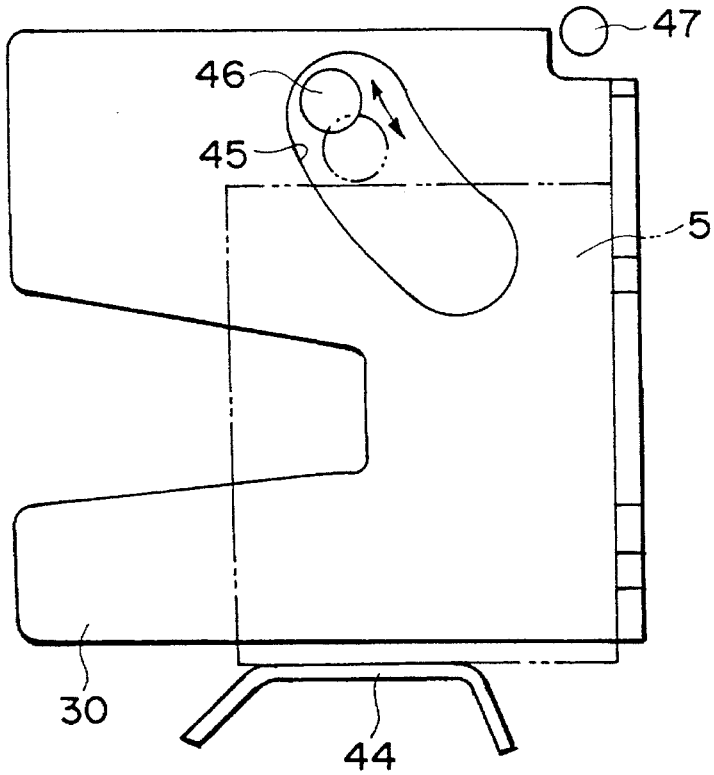
FIG. 5 is a plan view of the same bin unit, in which a sheet having had been discharged into the bin has been aligned with a aligning rod.

Further, a sector gear 49 is fixed to the axial shaft 47, adjacent to the bottom arm 8(*b*). The sector gear 49 receives the driving force from a reversible stepping motor 50 fixed to the bin frame. 38. Therefore, as the stepping motor 50 is rotated forward or in reverse, the aligning rod 46 is oscillated in the direction of an arrow as indicated in FIG. 5, whereby the sheet (or sheets) S accumulated and stored in each bin 30 are pressed against the alignment reference member 44, being thereby aligned. FIG. 2 shows a sheet set SA-1, which is the sheet set 8A before it is aligned by the aligning rod. 46, and a sheet set SA-2, which is the sheet set SA after the alignment.

Further, the bin unit 2 is vertically moved up or down along left and right guide rails 51 and 51 formed on the frame 4 of the main unit 1 of the sorter, with its top guide pins 43(*a*) and 43(*b*), and bottom guide pins 42(*a*) and 42(*b*) being engaged with the left and right guide rails 51 and 51, respectively; therefore, the positional relationship between the bin unit 2 and main unit 1 of the sorter relative to the direction of an arrow A can be precisely fixed.

FIG. 6 shows the positional relationship between the adjacent trunnions of the adjacent bins B shifted by the lead cam 11.

As the bin unit 2 is shifted upward, the trunnions of each bin B move one after another along the spiral cam groove 66. When a trunnion 31A of the first bin B which engages with the spiral cam groove 66 reaches the ending portion of the spiral cam groove 66, a trunnion 31B of the second bin B to engage with the spiral cam groove 66 is positioned at the horizontal portion, that is, the mid portion, of the spiral cam groove 66, and a trunnion 31C of the next bin B to engage with the spiral cam groove 66 is positioned at the starting portion of the spiral cam groove 66. The above described relationship holds also when the bin unit 2 is shifted downward.

At this time, an interval X1 between the trunnions 31A and 31B, and an interval X2 between the trunnion 31B and 31C are substantially expanded compared to an interval X3 between the trunnions 31A and 31D. Therefore, when the bin B is positioned at the middle point of the lead cam 11, directly facing the sheet delivery roller pair 12, the intervals between this bin B and the bins B directly above and below are opened wade on the sheet entry side. As a result, not only can the sheet S be easily discharged into the bin B, but the stapler can also be easily advanced, which will be described later.

It should be noted here that as the trunnions 31 of each bin B are moved up or down, the bin unit 2 vertically shifts the main unit 1 of the sorter, up or down.

Next, referring to FIGS. 7 and 8, the structure of the stapling unit 3 will be described.

A movable mount 92 is disposed on a stapler stay 91 supported on the main unit 1 of the sorter. It is movable, being guided by guiding means 91*a* and 91*b*, in the direction of an arrow Y (direction perpendicular to the sheet delivery direction) indicated in the drawing. This movable mount 92 is fixed to a timing belt 93 using an unillustrated member, and as a reversible pulse motor 94 is turned on, the timing belt 93 is driven to move the movable mount 92 in the arrow Y direction.

On the movable mount 92, another movable mount 95 is disposed, which is advanced or retracted in the direction of an arrow X indicated in the drawing, being guided by left and right guides which are parallel. This second movable mount 95 is connected to a connecting rod 97 at an axial point 97*b*. The connecting rod 97 is connected to a crank pulley 96, which rotates about an axial point 96*a*, at an axial point 97*a*. This crank pulley 96 is driven by a driving motor 98 through timing belts 99*a* and 99B, wherein when the driving motor 98 is turned on, the movable mount 95 is advanced or retracted in the arrow X direction, with the connecting rod 97 rotating, in relative terms, about the axial points 97*a* and 97*b*. FIG. 7 illustrates the home position, wherein as the crank pulley 96 is rotated, the connecting rod 97 is moved to the left, moving thereby the movable mount 95 leftward to the binding position. As the crank pulley 96 is further rotated, the movable mount 95 is returned to the position illustrated in FIG. 7.

On the movable mount 95, two staplers 90*a* and 90*b* are disposed using a connecting mount 100 disengageable from the movable mount 95.

When the stapler 90*a* and 90*b* are set and driven at the positions indicated in FIG. 7 in this stapling unit 3, the sheet set SA can be bound by the method (2) described with reference to the prior art.

Let it be assumed that while the sheet set SA is bound using the method (2), one of the staplers malfunctions due to the out-of-staples, staple jam, and/or like condition. In such a case, first, the sheet set SA is bound with the remaining (functioning) stapler; then, the functional stapler is moved to be set at a predetermined point where the currently malfunctioning stapler should have been set: and the sheet set SA is bound at this second point to complete the intended method (2).

Figure 9:
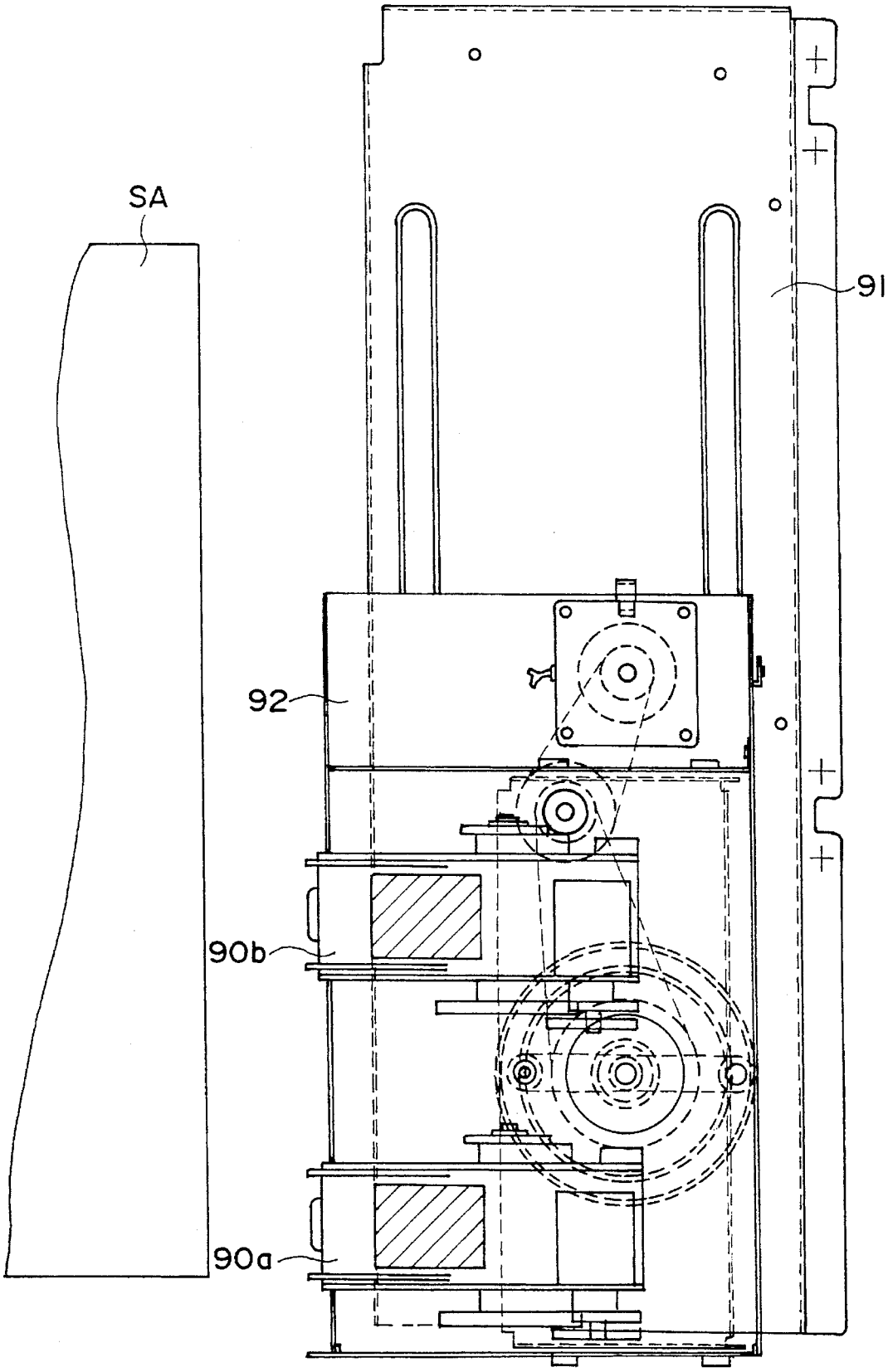
FIG. 9 is a plan view of the same stapling unit, and it shows where the stapler is positioned for single point binding.

Also, when the staplers 90*a* and 90*b* are set at the respective points as shown in FIG. 9, and the stapler 90*a* is driven, the sheet set SA can be bound by the method (1) described with reference to the prior art.

Further, when the stapler 90*a* malfunctions due to the out-of-staples, staple jam, and/or like condition while the sheet set SA is bound by the method (1), the sheet set SA cannot be bound with the stapler 90*b* because of the structural configuration of the apparatus; therefore, it is normal that the binding operation is prohibited. However, if it is possible to move and set the currently functioning stapler 90*b* at the predetermined point where the disabled stapler 90*a* should have stapled, the binding by the method (1) can be completed.

Next, referring to FIGS. 11 and 12, the structures of the staplers 90*a* and 90*b* will be described.

Forming portion 101 forms a staple 105 delivered thereto by a roller 106 into a U-shaped staple 105 one by one. As a stapling motor 110 is turned on, an eccentric cam gear 108 is rotated through a gear train 109, whereby the forming portion 101 is oscillated in the direction of an arrow mark to carry out a clinching (binding) operation in conjunction with a stapling table 102.

The staple 105 is loaded in a cartridge 103, and is under the pressure from a spring 104, providing a roller 106 with a delivery force.

Next, methods for detecting the staple jam condition and the out-of-staples condition of the stapler 90*a* or 90*b* will be described.

First, the method for detecting the staple jam condition will be described.

Figure 11:
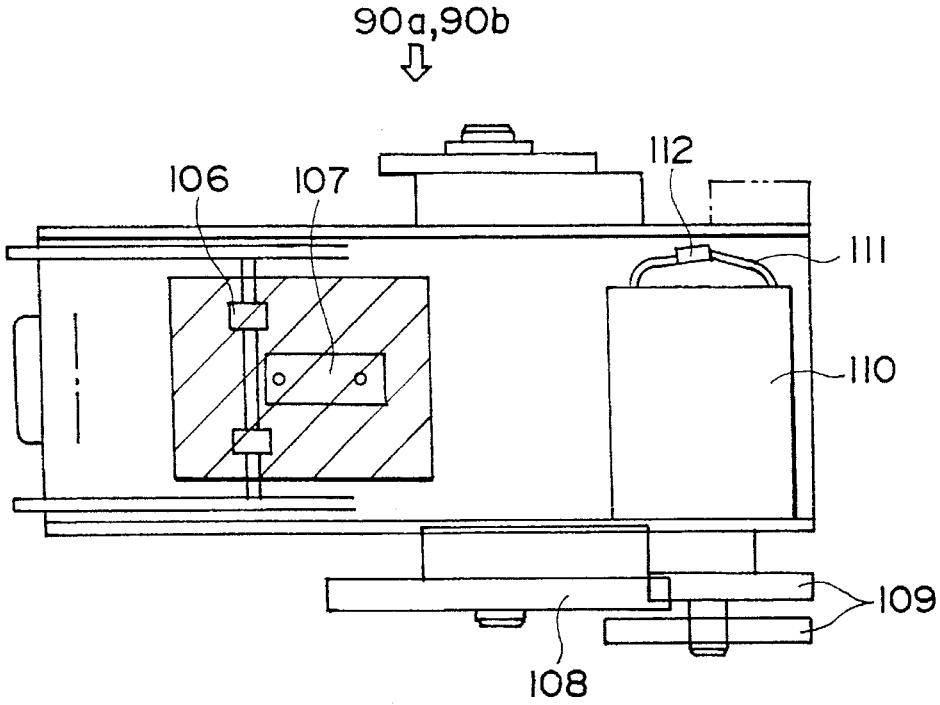
FIG. 11 is a plan view of the structure of the stapler provided in the same stapling unit.

Referring to FIG. 11, a numerical reference 111 designates a cord for supplying a current to drive the stapling motor 110, and 112 designates a current sensor (malfunction detecting sensor) as load detecting means for detecting the value of the current flowing through the cord 111.

Figure 13:
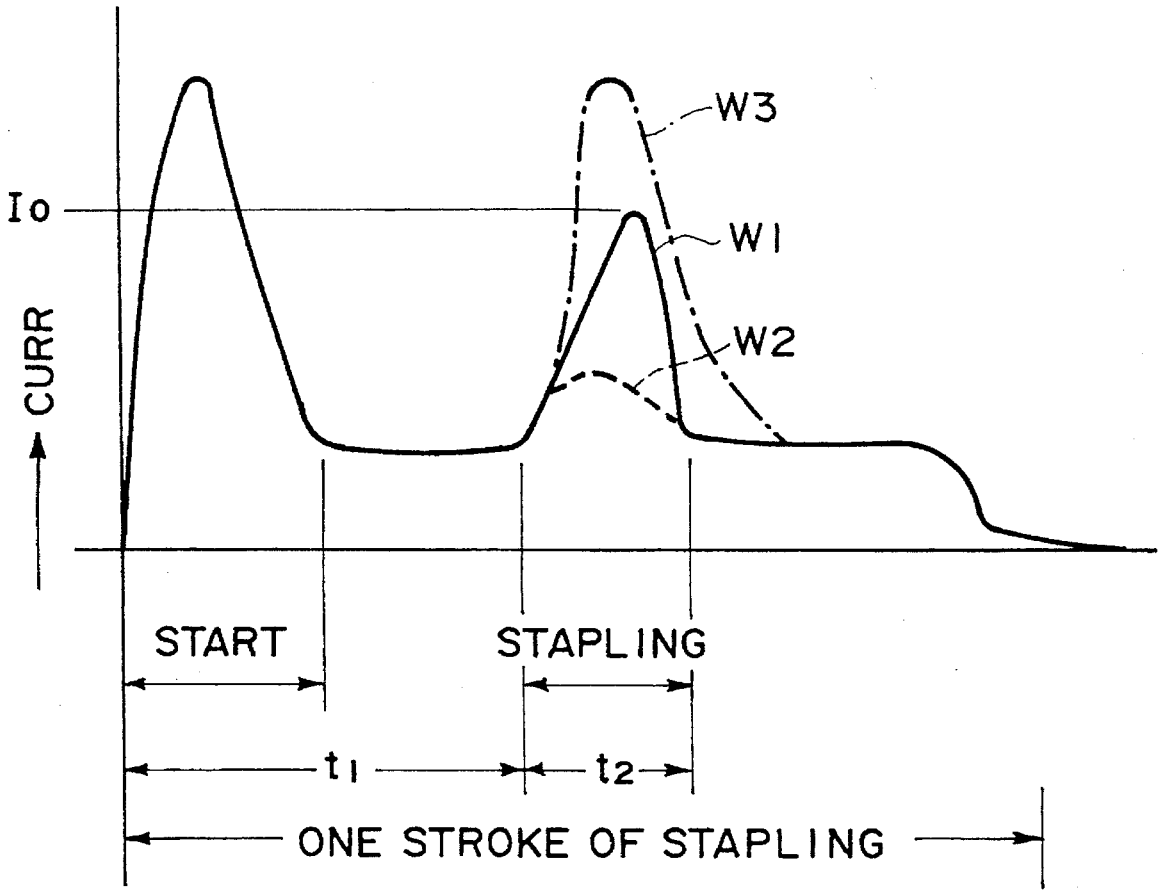
FIG. 13 is a graph showing the wave pattern formed by the detected values of the electric current which flows through the stapler motor each time the stapler strikes a staple.

FIG. 13 shows a wave-form obtained by plotting sequentially the value of the current flowing through the stapling motor 110 during a single stapling action, which is detected by the current sensor 112.

An alphanumerical reference W1 designates a wave-form obtained when a staple is normally delivered, is successfully stricken through the sheet set SA, and bent. A reference W2 designates a waveform obtained by a "blank shot" (stapler operates but no staple comes out). During the "blank shot," there is no load that is generated as a staple penetrates through the sheet set SA or as the staple is bent; therefore, the current value is small. A reference W3 designates a wave-form related to the malfunction in striking, staple jam, or the like. In this case, an overload condition occurs, which increases the current value to an extremely high level.

Therefore, when the current level remains near a value I0 (initialized value), it can be determined that the sheet set SA is being normally bound; when $I>I0+C$ (C: dispersion), it can be thought that an anomaly such as a staple jam, malfunction in striking, stapling mechanism malfunction, or the like, has occurred; and when $I<I0-C$, it can be determined that the "blank shot" has occurred.

Next, the method for detecting the out-of-staples condition will be described.

The condition in which the staplers 90*a* and/or 90*b* are out of the staples is detected by a reflection type sensor 107 illustrated in FIG. 11. This reflection type sensor 107 is disposed adjacent to the bottom portion of the cartridge 103 to detect the presence or absence of the staples 105 in the cartridge 103.

As for the timing for detecting the last staple, it is set up so that the sensor 107 detects "the last staple" with some remaining. For example, when the number of the bins 30 is ten, and the sheet set SA is bound at two points, the sensor 107 detects "the last staple" with at least 20 staples (10×2) in remain.

With this arrangement, even when the out-of-staples condition occurs during the stapling operation, the on-going jog can be completed with no interruption.

Next, methods for displaying the out-of-staples condition and/or staple jam which have occurred in the staplers 90*a* and/or 90*b* will be described.

Figure 14:
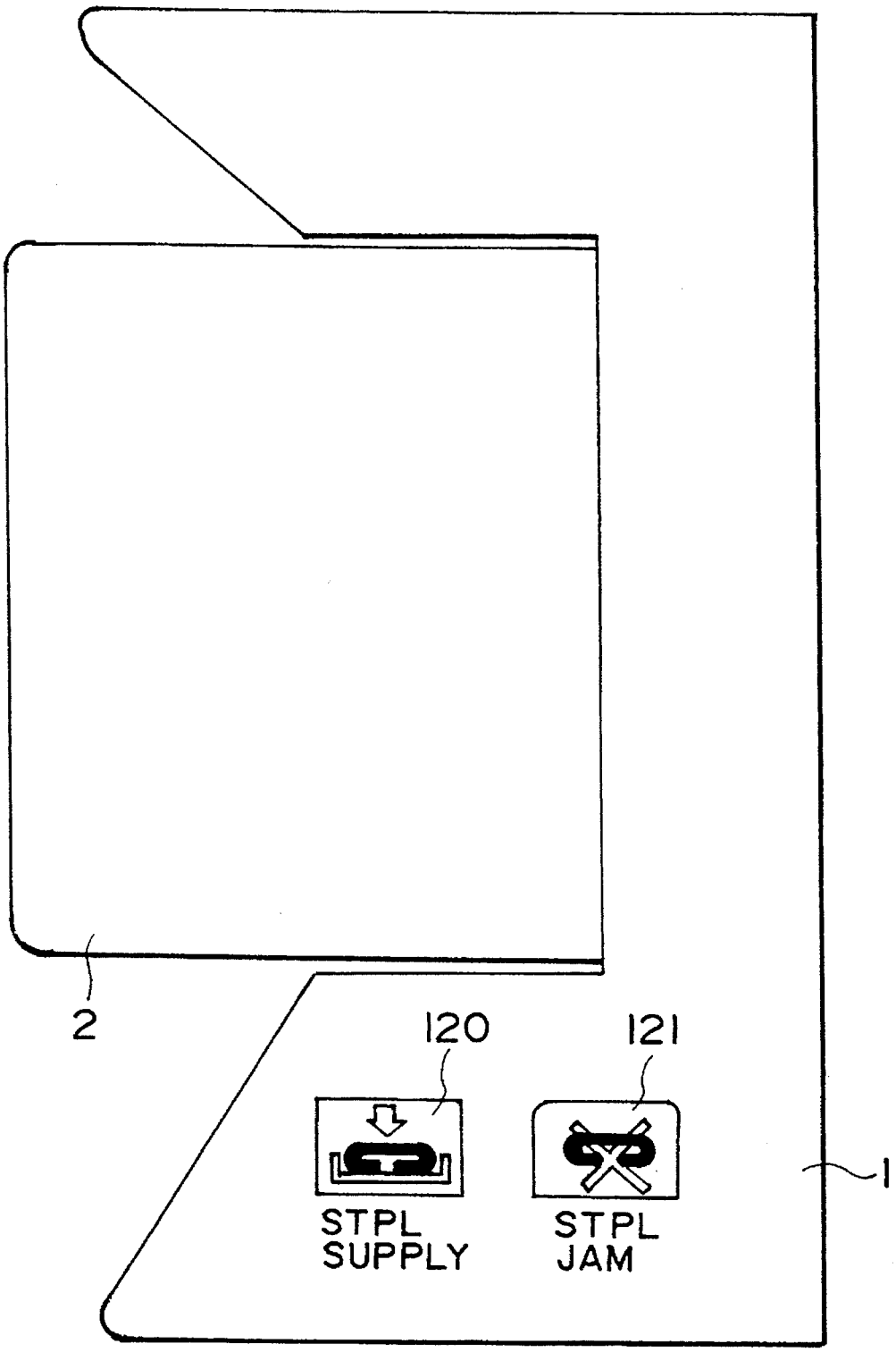
FIG. 14 is a plan view of the out-of-staples display portion, which shows the out-of-staple condition of the stapler, and the staple jam display portion, which shows the staple jam condition of the stapler.

Referring to FIG. 14, in the case of this sorter, a single out-of-staple display portion (malfunction displaying means) 120 shared by the staplers 90*a* and 90*b*, and a single staple jam display portion (malfunction displaying means) 121 shared also by the staplers 90*a* and 90*b* are disposed on the top surface of the main unit 1 of the sorter, on the front side. When the occurrence of the out-of-staples condition is detected in the stapler 90*a* and/or 90*b*, the out-of-staples display flashes, and when the occurrence of the staple jam condition is detected in the stapler 90*a* and/or 90*b*, the staple jam display portion 121 flashes.

Figure 15:
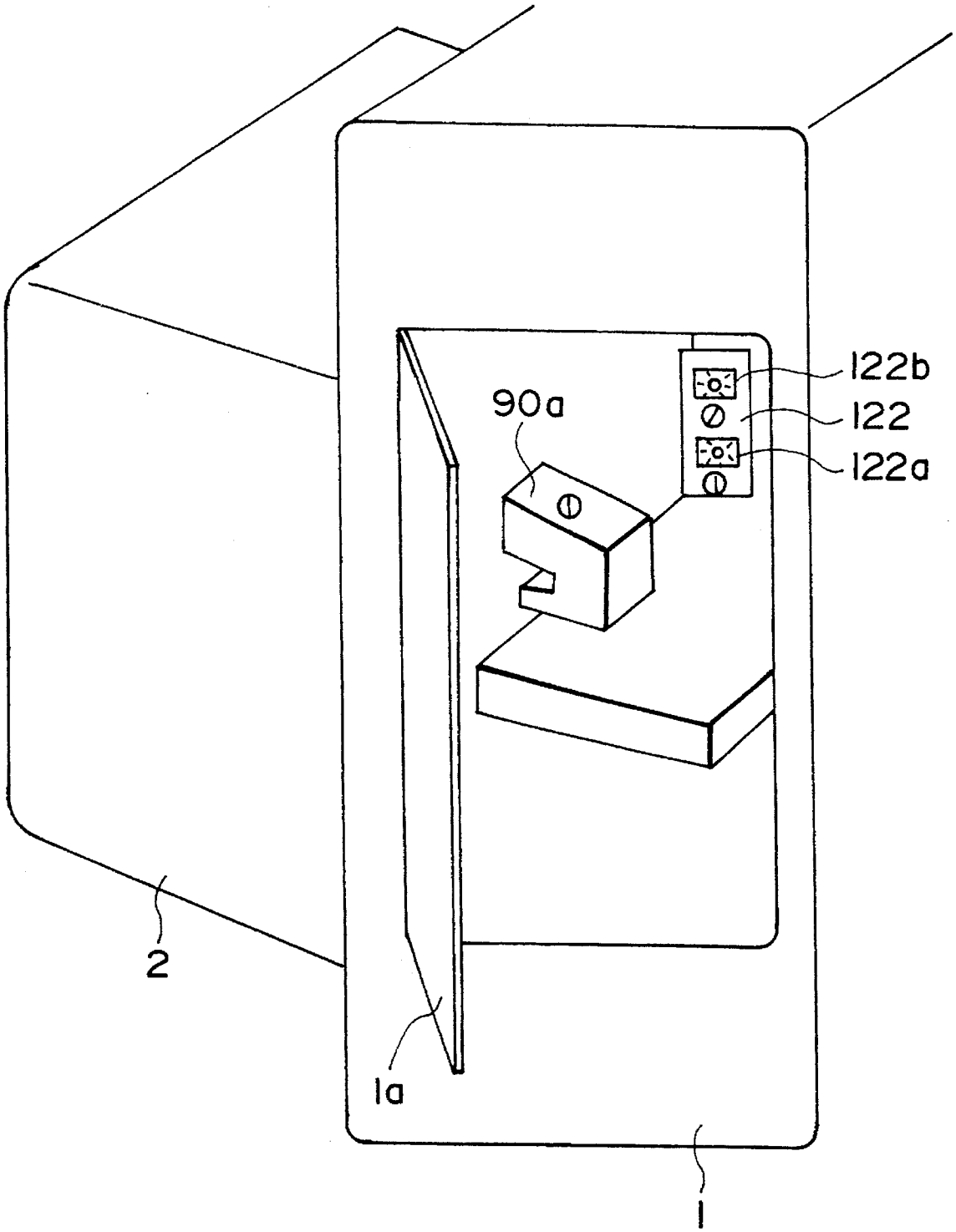
FIG. 15 is a perspective view of a stapler display, which shows the stapler out of staples or jammed by a staple.

Further, referring to FIG. 15, in this sorter, a stapler malfunction displaying portion 122, which indicates the stapler, which has run out of, or has been jammed with, the staple, is disposed adjacent to the front door la of the sorter main unit 1. When the stapler 90*a* on the front side (1) runs out staples or is jammed with the staple, the LED of the display 122*a* on the front side (1) flashes, and when the stapler 90*b* (unillustrated) on the rear side (2) runs out of, or is jammed with, the staple, the LED of the display portion 122*b* on the rear side (2) flashes, so that the operator is informed of the stapler suffering from the anomaly.

Figure 16:
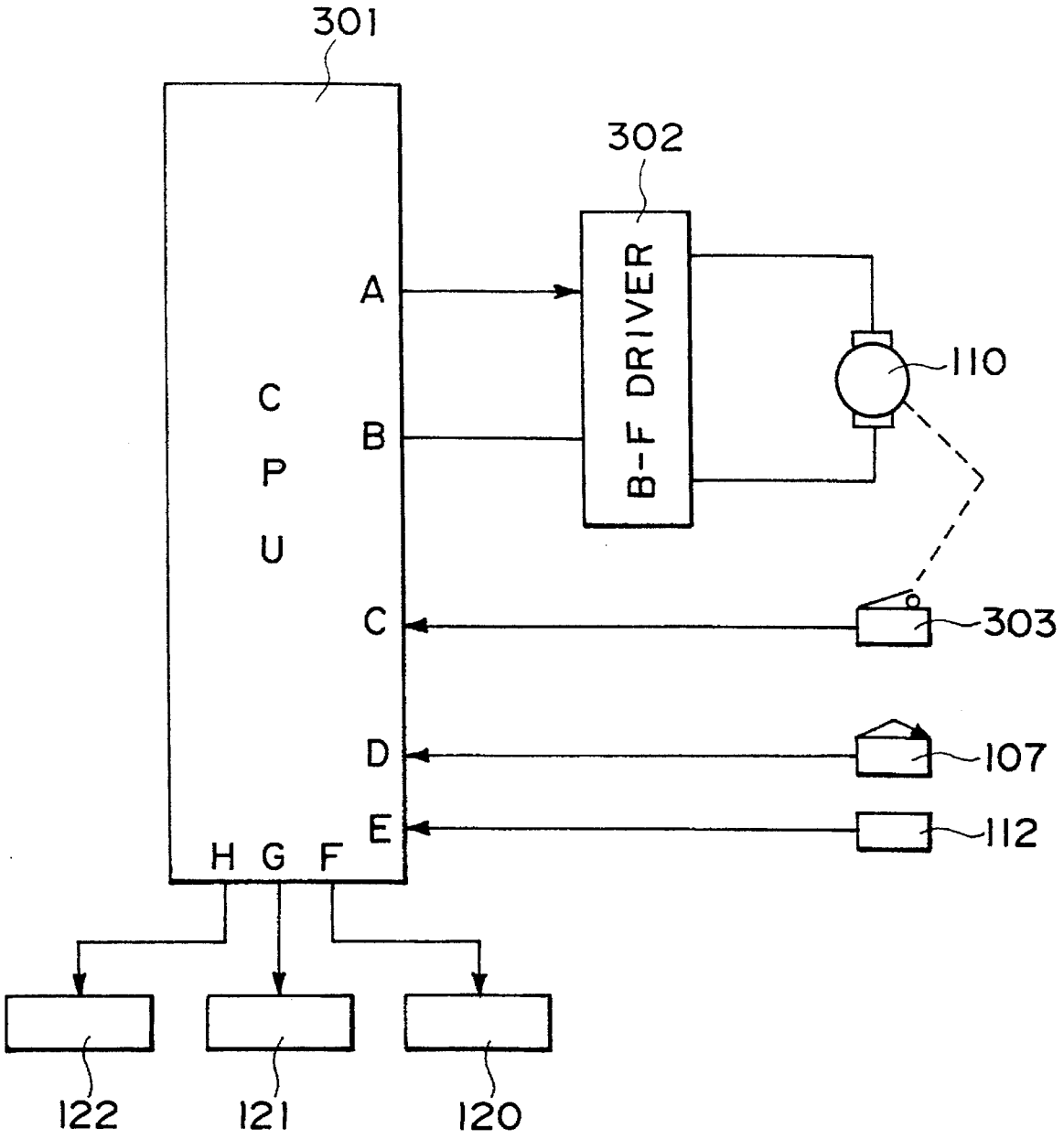
FIG. 16 is a block diagram of the structure of the control circuit in the same moving-bin type sorter.

FIG. 16 shows the structure of the control circuit of this sorter.

A reference numeral 301 designates a CPU as the controlling means. As for the CPU, a well-known microcomputer or the like is employed, in which a program sequence for sequentially controlling the sorter is stored.

The terminals A and B of the CPU 301 are output terminals, through which the CPU output is sent to a back-and-forth driver 302 for rotating forward or in reverse the stapling motor 110. More specifically, when the output terminal A is on, a normal stapling operation is carried out, but when the output terminal B is on, an emergency reversal operation is carried out.

Figure 12:
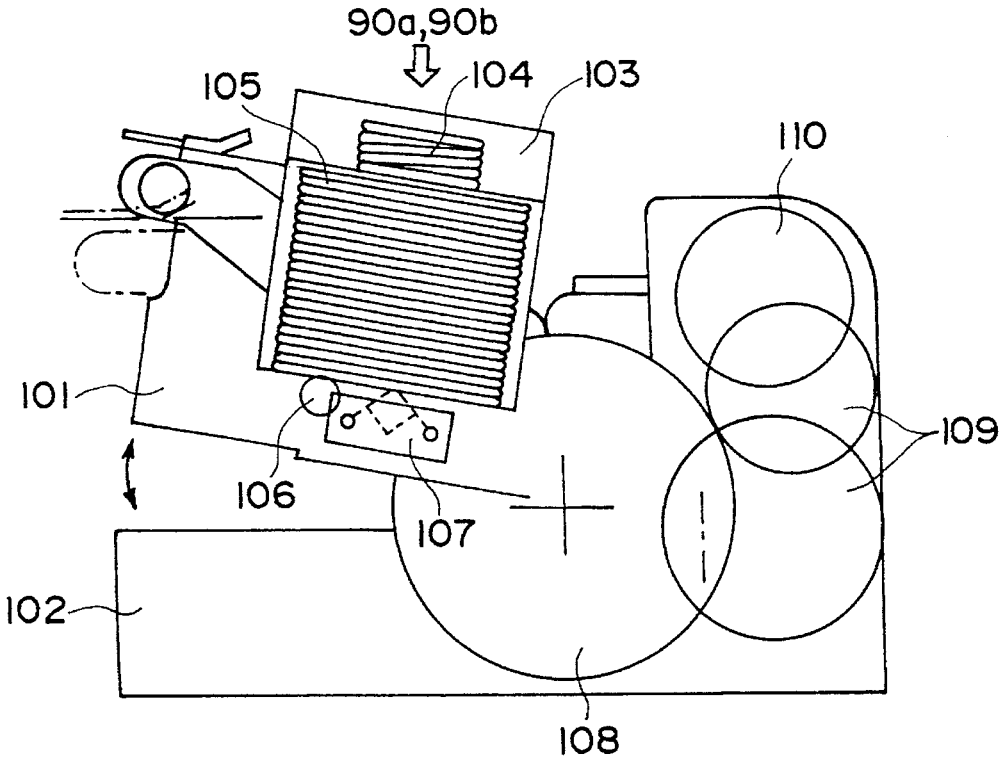
FIG. 12 is a vertical section of the structure of the stapler.

Normally, when the heads 101 of the stapler 90*a* and 90*b* are at the home positions, respectively, as shown in FIG. 12, corresponding home position sensors 303 are being depressed (in the "on" condition), and this "on" condition is inputted to the C terminal of the CPU 301.

In whichever direction the motor is rotated, forward or in reverse, as soon as the "on" signal is inputted by the home position sensor 303, the outputs at the terminals A and B of the CPU 303 are turned off, stopping thereby the stapling motor 110.

A D terminal is where a detection signal from the reflection type sensor 107 is inputted, and an E terminal is where a detection signal from the current sensor 112 is inputted.

Since the detection signal from the current sensor 112 is an analog signal, it is converted into a digital one within the CPU 301. When the CPU does not have such a function, an A/D converter is interposed to digitize the signal to be inputted into the CPU.

The CPU checks the detection signal sent from the current sensor 112, that is, the value I of the current flowing through the stapler motor 110. More specifically, when a peak current value Ip during a predetermined period t2, which starts a predetermined period t1 after the beginning of the stapling operation, satisfies: Ip>I0+C, it is determined that the stapler is in the abnormal condition. When Ip<I0–C, it is determined that the "blank shot" has occurred. The display signals are sent from terminals G, H and F to the out-of-staples display portion 120, staple jam display portion 121, and malfunctioning stapler display portion 122, correspondingly.

Further, the CPU is electrically connected to the bin shift motor 14, reversible motor 94, driving motor 98, or the like.

Figure 17:
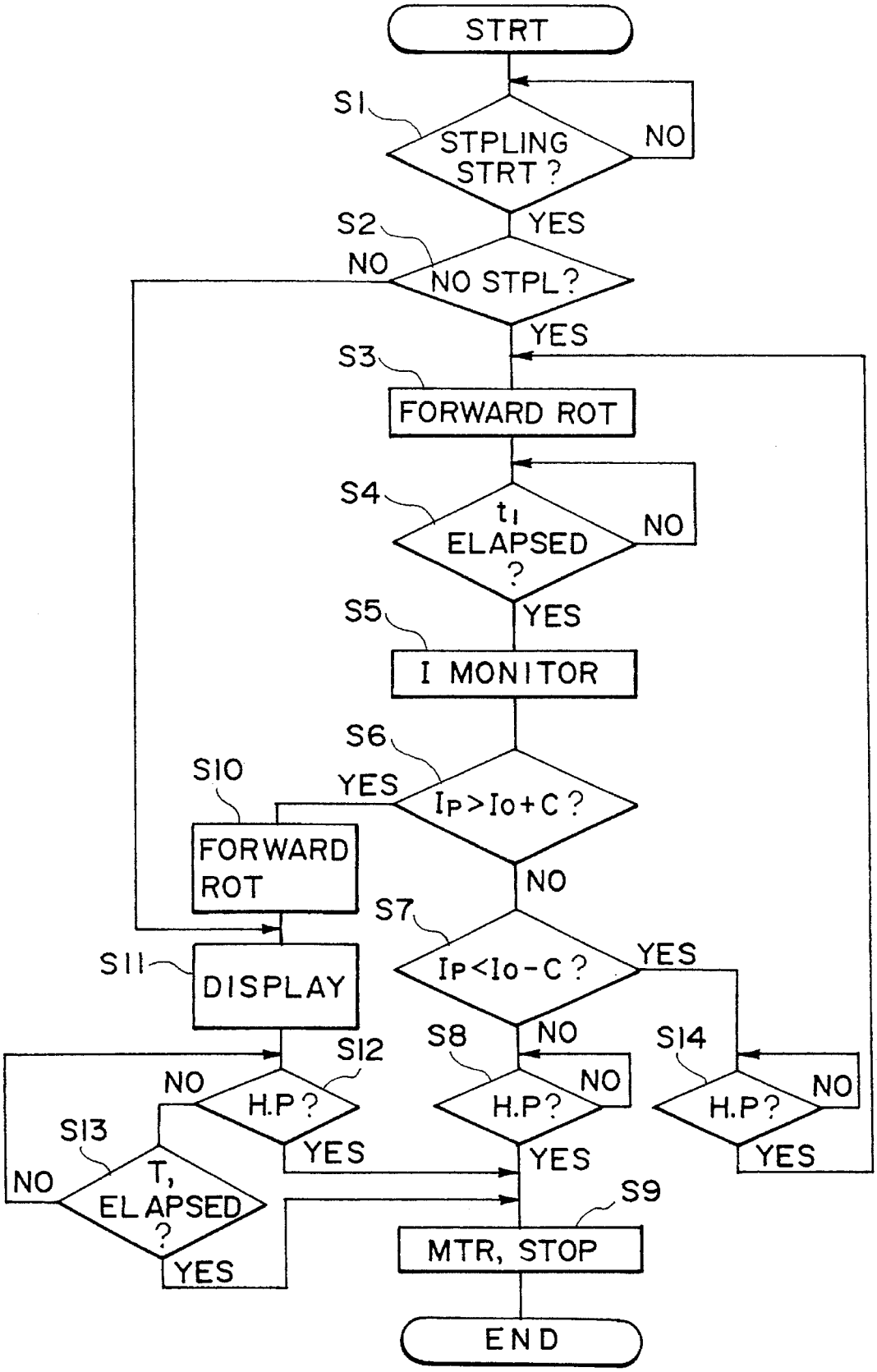
FIG. 17 is a flow chart depicting a stapling operation controlled by a CPU as a controlling means of the control circuit.
Figure 18:
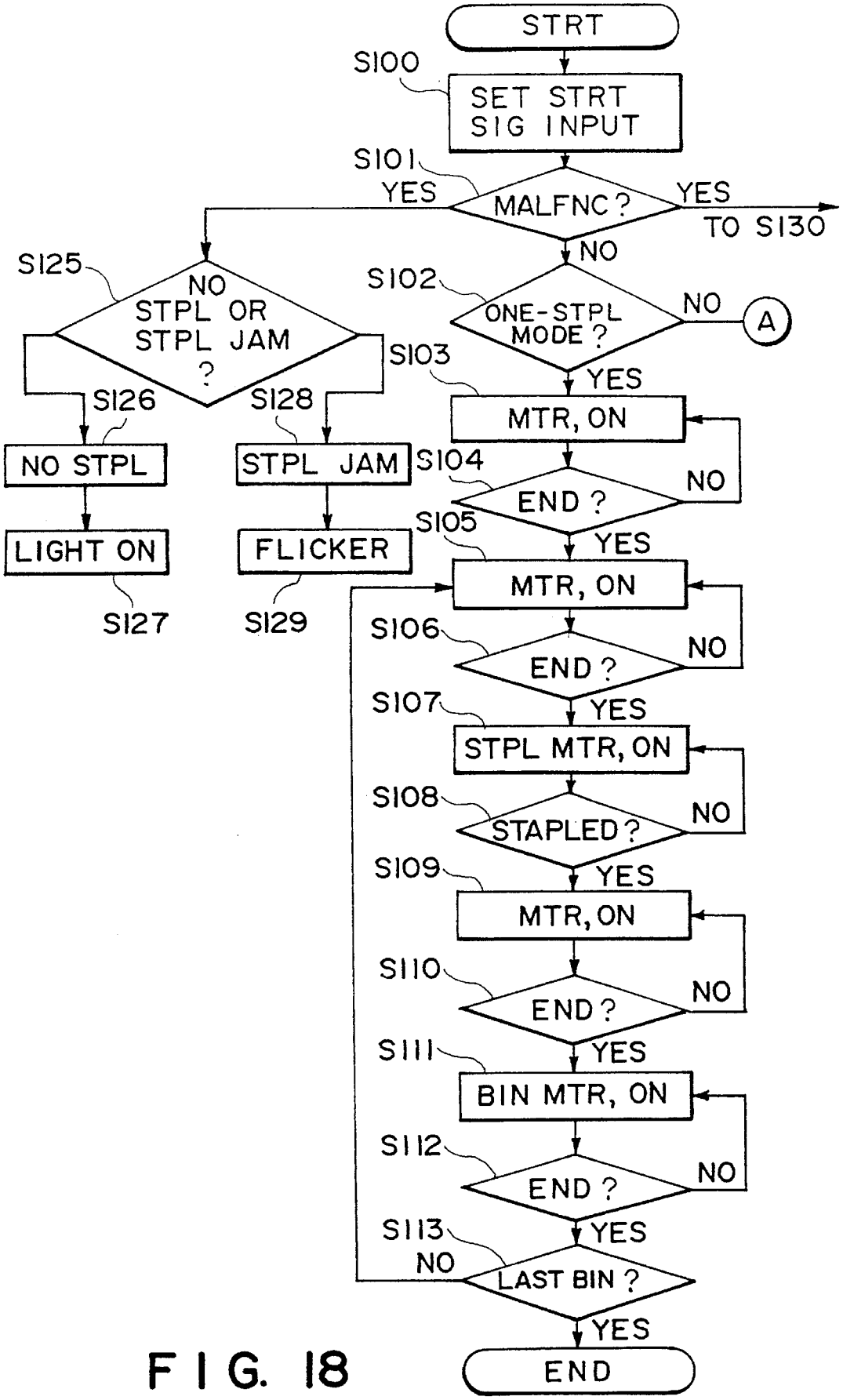
FIG. 18 is a flow chart depicting a stapler setting operation controlled by the CPU.
Figure 19:
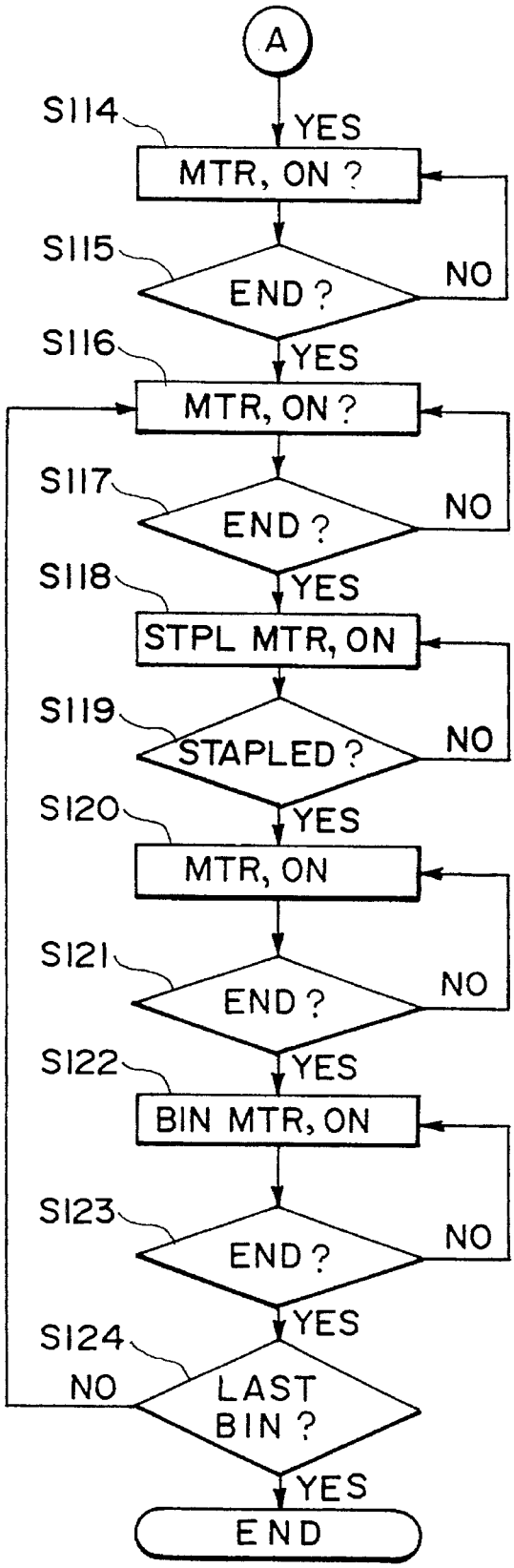
FIG. 19 is a flow chart depicting a stapler setting operation controlled by the CPU.
Figure 20:
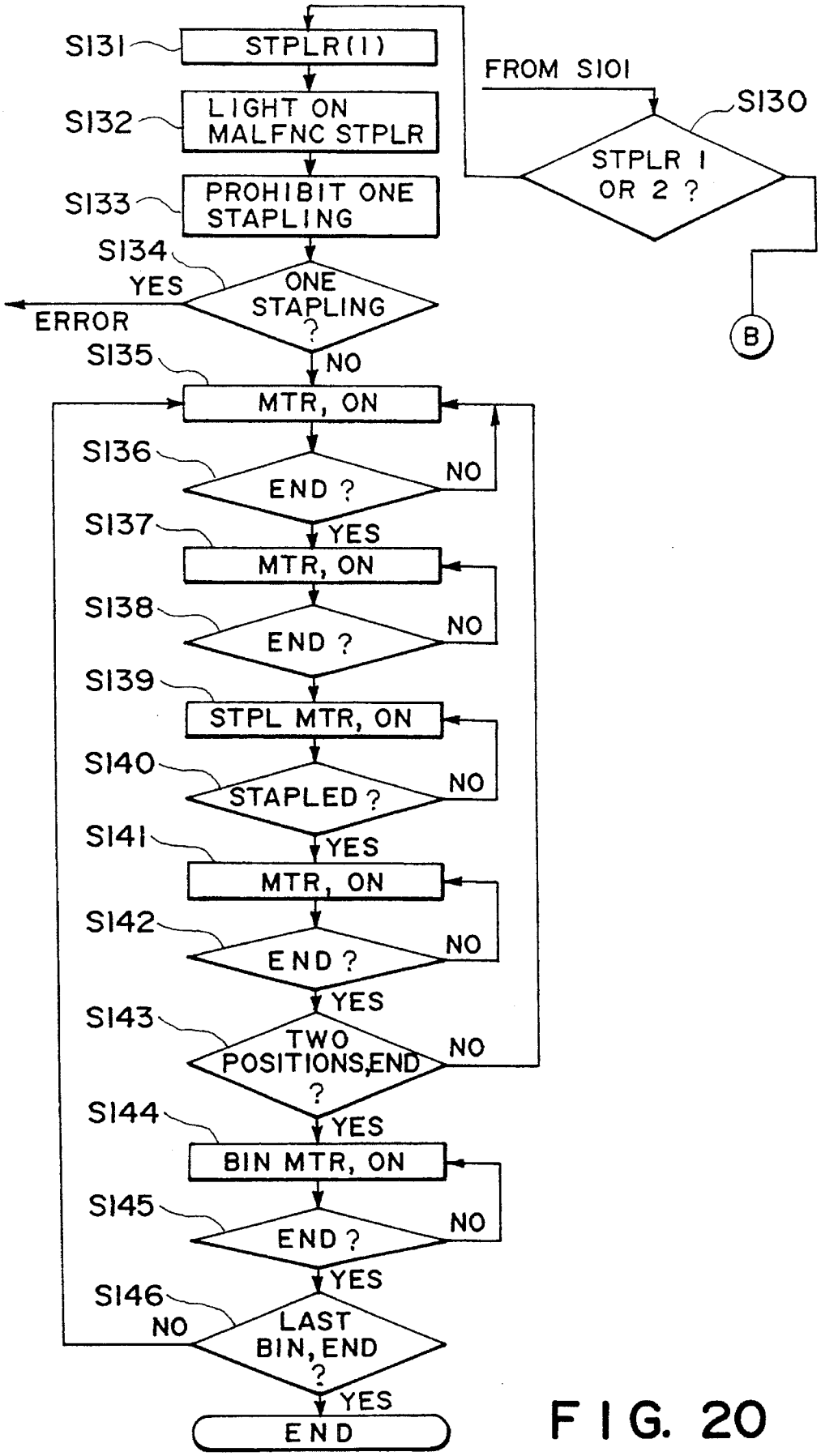
FIG. 20 is a flow chart depicting a stapler setting operation controlled by the CPU.
Figure 21:
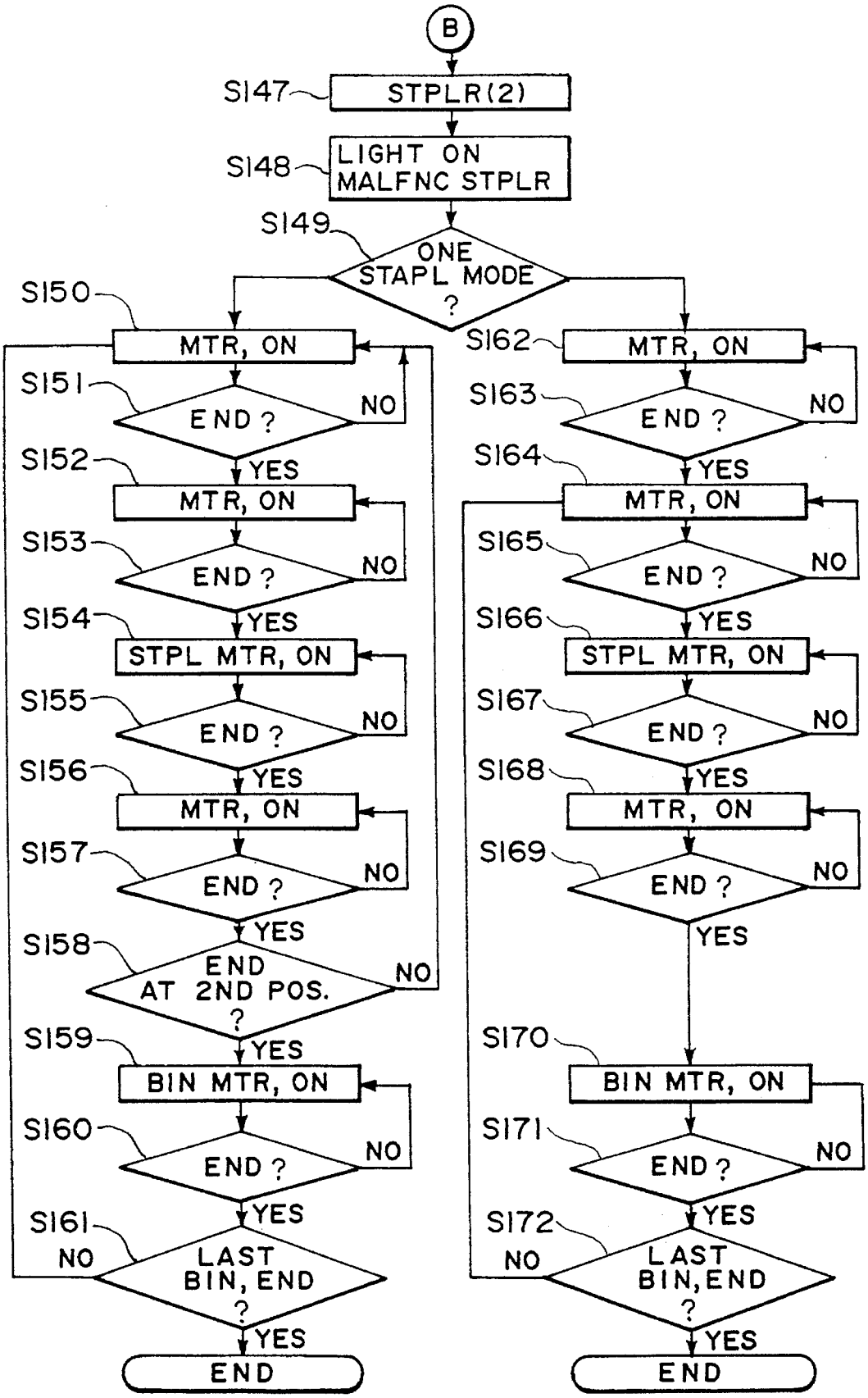
FIG. 21 is a flow chart depicting a stapling setting operation controlled by the CPU.

Next, referring to the flow chart in FIG. 17, the stapling operation controlled by the CPU will be described.

As it is determined that a stapling operation is initiated in step S1, the presence of the staple is confirmed in S2. Then, in S3, the output of the terminal A is turned on, whereby the stapling motor 110 is rotated forward.

In step 84, the predetermined duration of time t1 after the initiation of the stapling operation, the actual stapling operation is begun, and then, in S5, the value I of the current flowing through the stapling motor 110 which is inputted through the E terminal, is checked to obtain the peak current value Ip.

In steps S6 and S7, it is determined whether or not Ip is abnormal. When not, it is confirmed in S8 that the heads 101 of the staplers 90*a* and 90*b* have returned to the home positions, and the stapling motor 110 is stopped. When Ip>I0+C in step S6, that is, when Ip is abnormally large, it means that a staple jam or the like has occurred; therefore, the output of the terminal A is turned off and the output of the terminal B is turned on, so that the stapling motor is rotated in reverse.

Next, in step S11, the anomaly of the stapler 90*a* and/or 90*b* is displayed on the staple jam displaying portion 121 and/or stapler malfunction displaying portion 122. Further, after it is confirmed that the staplers 90*a* and 90*b* have returned to the home positions in step S12, the stapling motor 110 is stopped. When the staplers 90*a* and/or 90*b* does not return to the home position a predetermined duration of time T after the stapling motor 110 is rotated in reverse, it means the stapler 90*a* and/or 90*b* has been stopped by the staple jam or the like during the stapling operation, and in this case, the operation goes from S13 to S9, where the stapling motor 110 is stopped.

When it is determined in step S7 that Ip<IO –C, that is, when the Ip is abnormally small, it means that the "blank shot" has occurred, and in this case, it is confirmed in S14 that the staplers 90*a* and/or 90*b* have returned to the home positions, and then, the operation goes back to the step S3, where the stapling motor 110 is rotated forward again.

When the out-of-staples condition is confirmed in the step S2, the anomaly of the stapler 90*a* and/or 90*b* is displayed on the out-of-staples displaying portion 120 and malfunctioning stapler displaying portion 122 in step S11. Thereafter, it is confirmed in step S12 that the stapler 90*a* and/or 90*b* have returned to the home position, and next, the stapling motor 110 is stopped in S9.

Next, referring to flow charts in FIGS. 18 –21, a stapler setting operation controlled by the CPU will be described. It should be noted here that the description of the operational sequence, through which the sheet S is discharged from the image forming apparatus 900 and stored in each bin 30, is omitted since it is the same as the one for the conventional moving-bin type sorter.

As a signal for initiating the stapler setting operation (S100) is sent in, it is determined whether or not an anomaly such as the out-of-staples condition, staple jam or like malfunction exists (S101).

When the presence of the anomaly is confirmed, it is confirmed whether the anomaly is the out-of-staple condition or staple jam (S125), and in which stapler the anomaly has occurred (S130). When the stapler is out of the staple (S126), the out-of-staple displaying portion 120 is turned on (S127), and when the stapler has been jammed (8128), the staple jam displaying portion 121 is flashed (S129). When the anomaly is in the stapler 90*a* on the front side (1) (S131), the LED on the front side (1) of the malfunctioning stapler displaying portion 122 is turned on (S132), and when the anomaly is related to the stapler 90*b* on the rear side (2) (8147), the LED on the rear side (2) of tile malfunctioning stapler displaying portion 122 is turned on (S148).

NORMAL OPERATION

When the presence of no anomaly is confirmed in S101, 1; is confirmed whether the selected binding method is the single point binding (FIG. 9) or double point binding (FIG. 7) (S102), and then, the moving motor 94 is turned on (S103, S114) to move the staplers 90*a* and 90*b* to the corresponding predetermined positions.

Next, after it is confirmed that the staplers 90*a* and 90*b* have been moved to the predetermined locations, the back-and-forth motor 98 is turned on (S105, S116) to move the staplers 90*a* and 90*b* to the binding points.

After it is confirmed that the staplers 90*a* and 90*b* have been successfully advanced (S106, S117) the stapling motor 110 is turned on, wherein in the case of the single point binding, only the stapling motor 110 of the stapler 90*a* is activated, and in the case of the double point binding, both stapling motors 110 of the staplers 90*a* and 90*b* are activated (S107, S118) to carry out the double point binding operation.

When the completion of the binding action is confirmed (8108, S119), the back-and-forth motor 98 is turned on again (8109, S120), whereby the staplers 90*a* and 90*b* are moved to the retractive position.

Next, when it is confirmed that the staplers 90*a* and 90*b* have been retracted (S110, S121), the shift motor 14 is rotated by a predetermined number of revolutions (S111, S122) to shift the bin unit, whereby the next sheet set SA to be bound is moved to a predetermined position.

Then, after the completion of the bin shifting is confirmed, it is confirmed whether or not the last sheet set SA has been stapled (S113, S124), and when it has been, this sequence is ended.

ABNORMAL SITUATIONS Abnormal Situations

(*a*) Malfunction in Stapler (1) (90*a*)

Single Point Binding

When the anomaly occurs to the stapler (1) of this sorter, the single point binding at a point indicated in FIG. 9 cannot be carried out due to the structure of the apparatus; therefore, the single point binding is prohibited in S133.

When it is confirmed in S134 that the single point binding has been selected in this state, an error message indicating that the selected binding method has been prohibited is displayed on an unillustrated display of the sorter main unit 1.

Double Point Binding

When the double point banding is selected, the moving motor 94 is turned on, creating thereby a state illustrated in FIG. 9. At this time, the moving motor 94 is kept on for a given duration long enough to move the stapler 2 (90*b*) to the normal setting point for the stapler (1) (90*a*), and the stapler (1) fixed to the same movable mount 92 is retracted from the normal double binding point.

Figure 7:
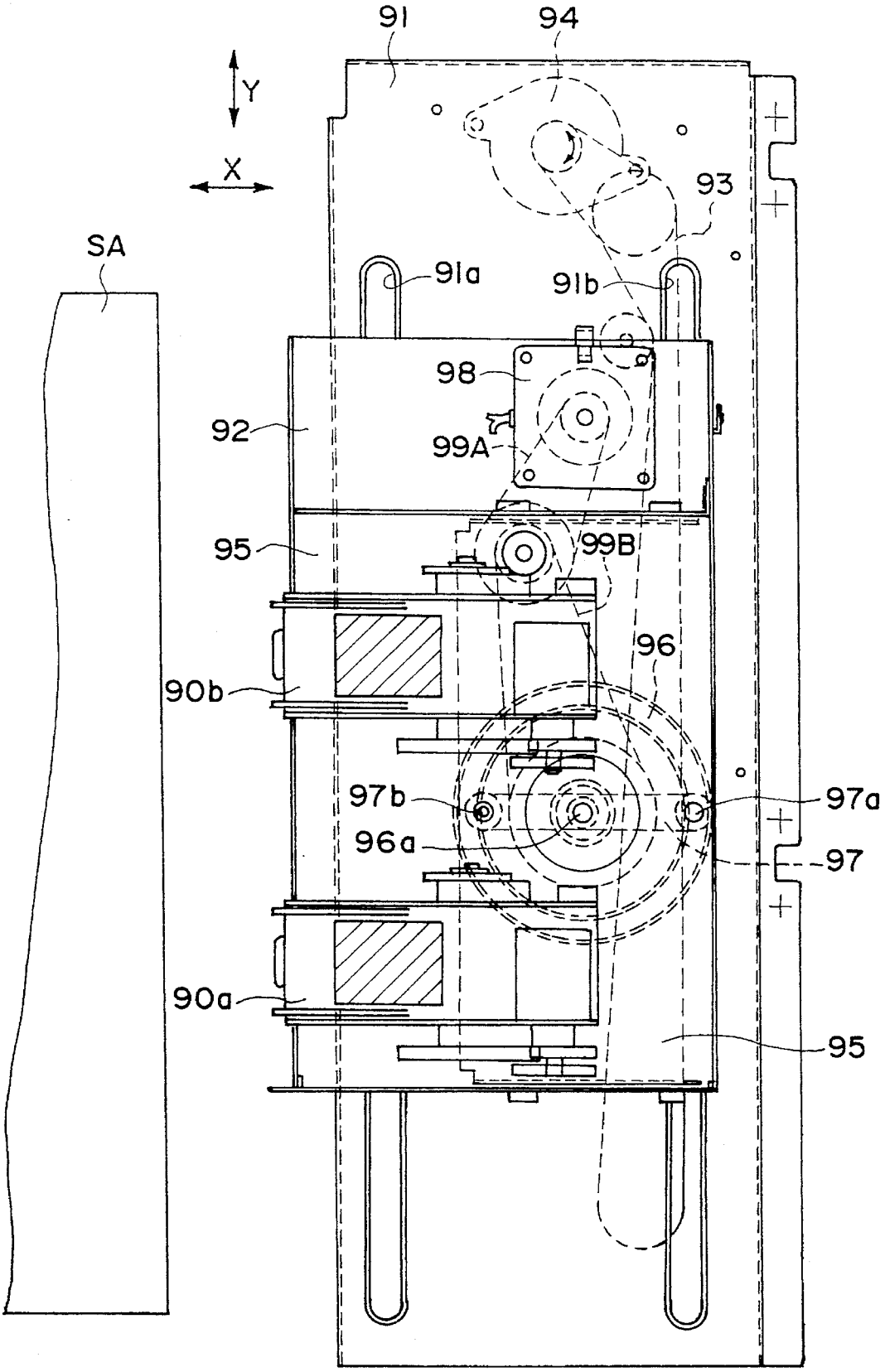
FIG. 7 is a plan view of the structure of a stapling unit provided in the same moving-bin type sorter, and it shows the positions where the stapler is set for two point binding.
Figure 8:
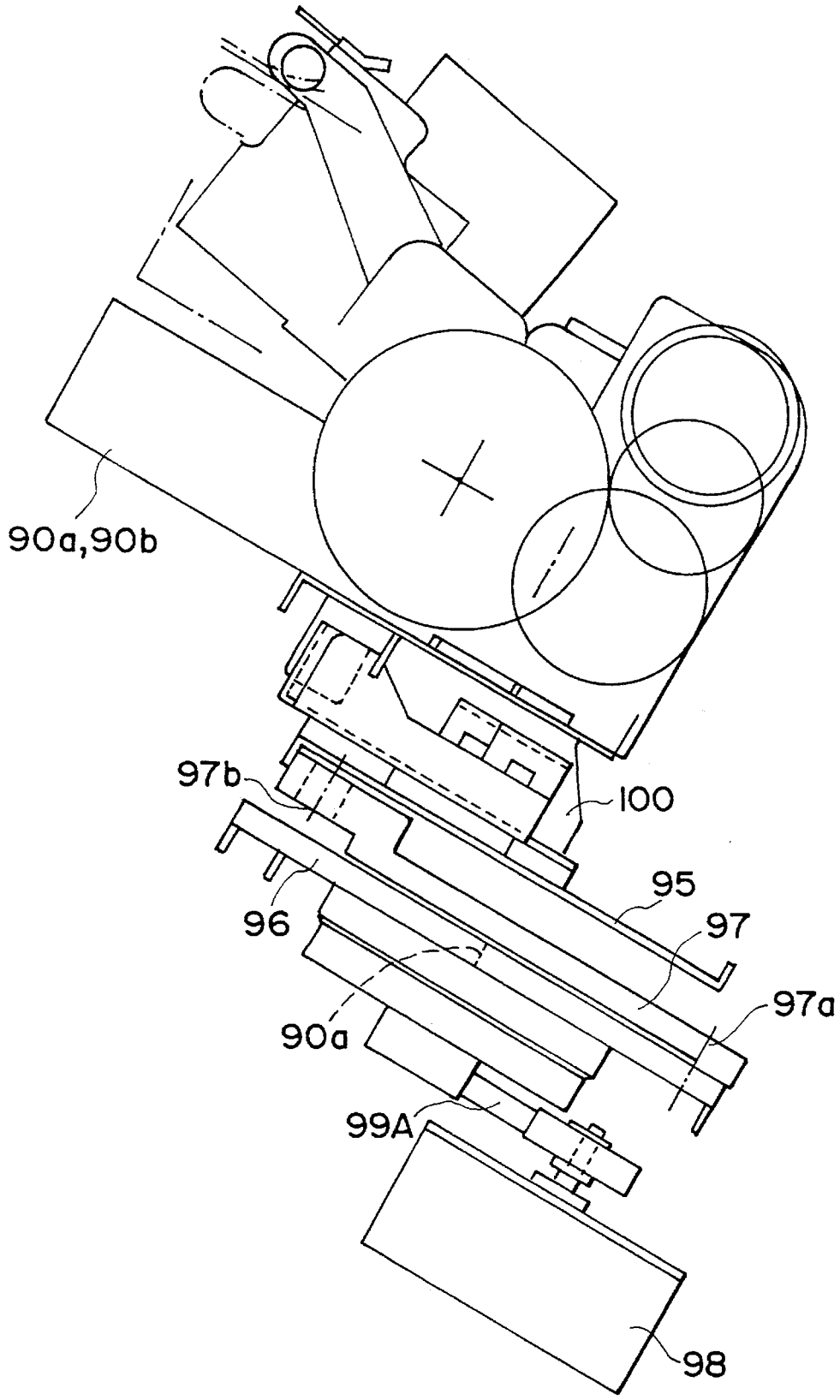
FIG. 8 is a vertical section of the same stapling unit.

Next, after the binding operation is carried out (S137–S142) in the same manner as the aforementioned sequence S105–S110, the bin shift is not carried out, and instead, in this state, the moving motor 94 is turned on, realizing thereby a state depicted in FIG. 7. At this time, the stapler (2) is set where it should be for the double point stapling.

Thereafter, the sequence S137–S142 is repeated to bind the sheet set SA at the second binding point with the stapler (2).

Next, after it is confirmed that the binding at the second point has been completed (S143), the shift motor 14 is turned on (S144) to initiate the post-image formation processing for the next bin. Then, this sequence is ended after steps S145 and S146, which are the same as the aforementioned steps S112 and S113, respectively.

(*b*) Malfunction in Stapler (2) (90*b*)

When the stapler (2) is in the abnormal condition, it is possible to use the stapler (1) to carry out the single point binding depicted in FIG. 9 and the double point binding depicted in FIG. 7.

In this case, the single point binding operation (S162–S172) is the same as the aforementioned normal operation (S103–S113); therefore, its description will be omitted.

Figure 10:
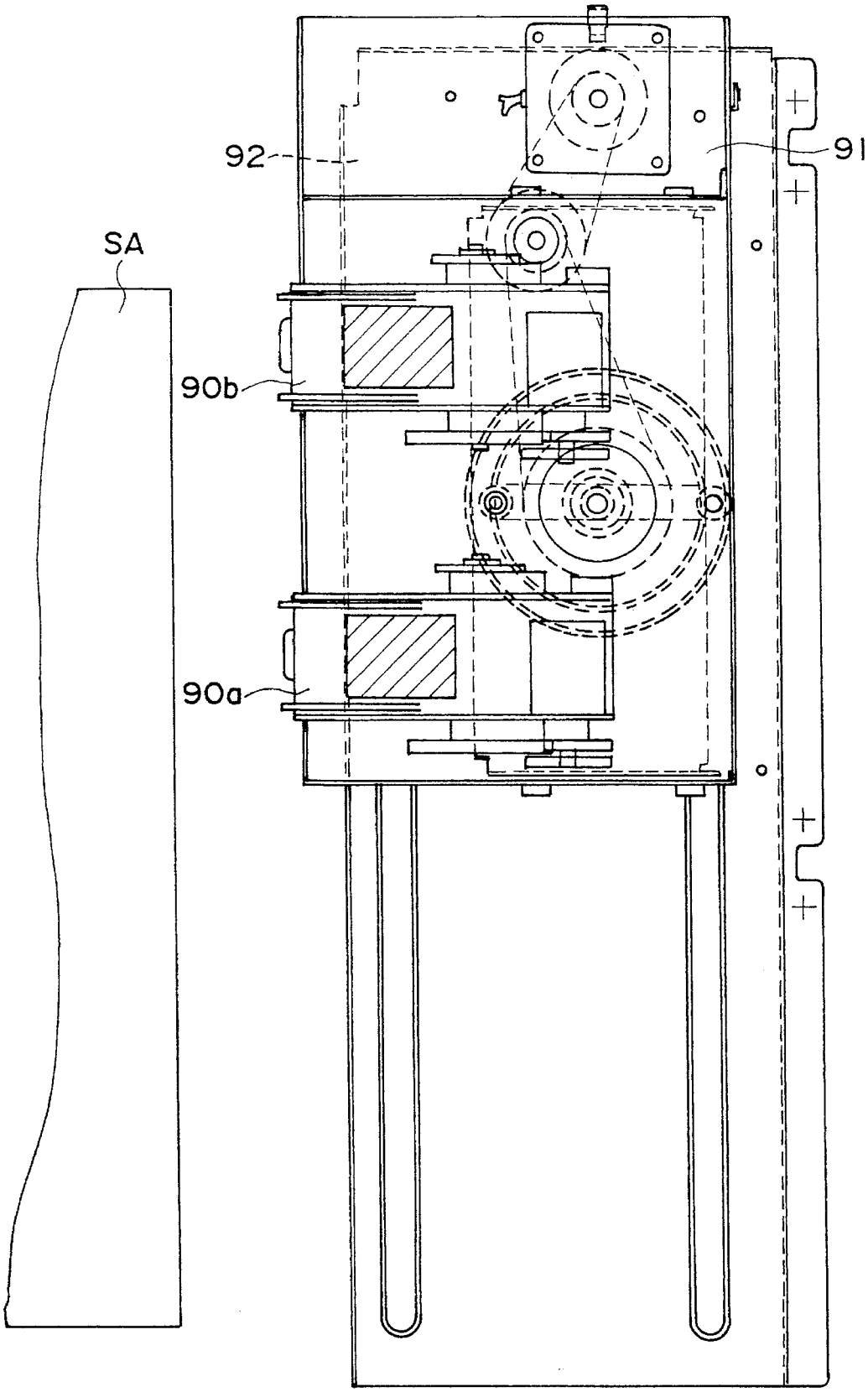
FIG. 10 is a plan view of the same stapling unit, in which a stapler, to which no malfunction had occurred, has been moved to be set at where a stapler, to which the malfunction had occurred, was located.

An operational sequence (S150–S161) for the double point binding is substantially the same as the operational sequence (S136–S146) carried out when the anomaly is detected, except that the stapler (2) is replaced by the stapler (1) and the replacing stapler (1) is set as shown in FIG. 7 or 10; therefore, its description will be omitted.

Further, when the anomaly occurs to one of the staplers 90*a* or 90*b* while the above mentioned operation is carried out, it is first determined "which stapler is involved," and "whether the operation is the single point binding operation or double point one," and then, the role having been assigned to the manfunctioning stapler is transferred to the other stapler to continue the same mode following the aforementioned flow; therefore, the description of this case will be omitted.

Figure 22:
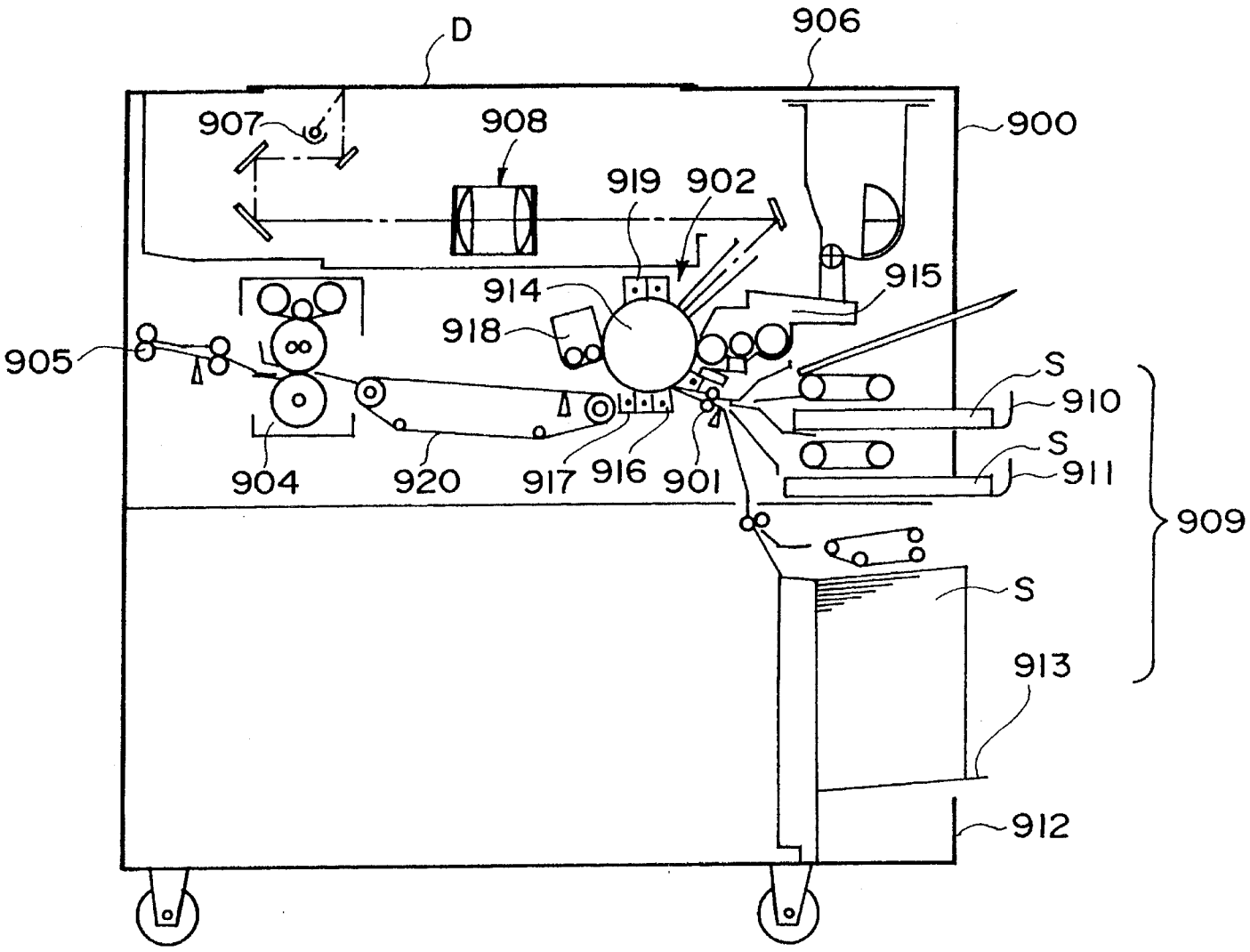
FIG. 22 a vertical section of the structure of an exemplary image forming apparatus (copying machine) comprising the moving-bin type sorter.
Figure 23:
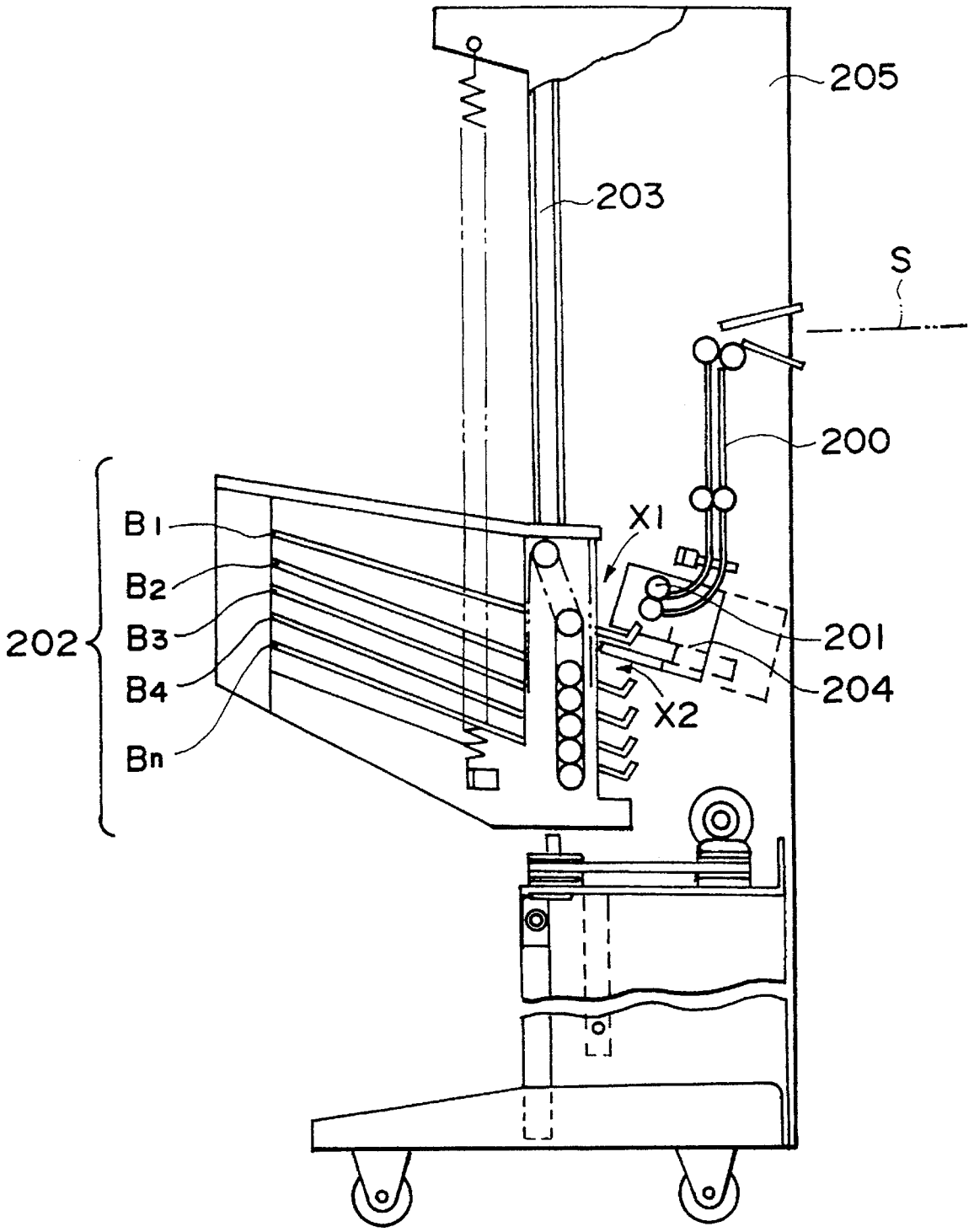
FIG. 23 PRIOR ART
FIG. 23 is a vertical section of the general structure of a conventional moving-bin type sorter comprising a single stapler.
Figure 24:
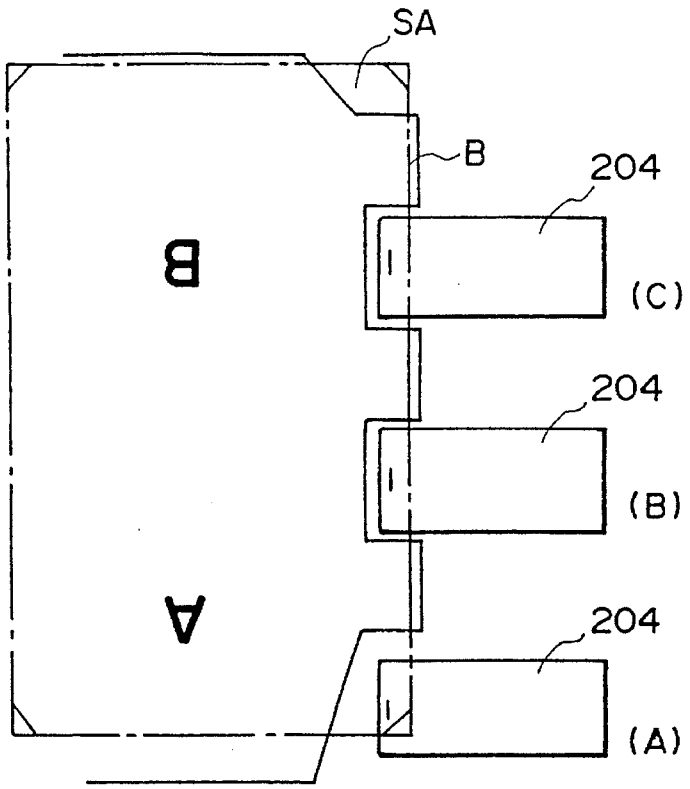
FIG. 24 PRIOR ART
FIG. 24 is a plan view of the structure which offers choices of binding methods using the stapler.
Figure 25A:
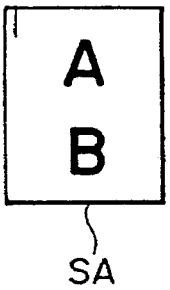
FIG. 25(a) PRIOR ART
FIGS. 25(*a*), (*b*) and (*c*) are a plan view of sheet sets having been bound by various binding methods.
Figure 25B:
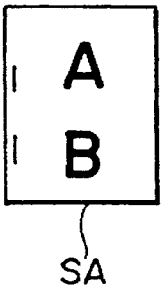
FIG. 25(b) PRIOR ART
Figure 25C:
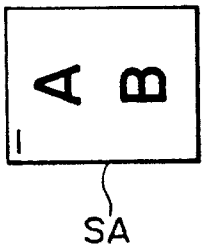
FIG. 25(c) PRIOR ART
Figure 26A:
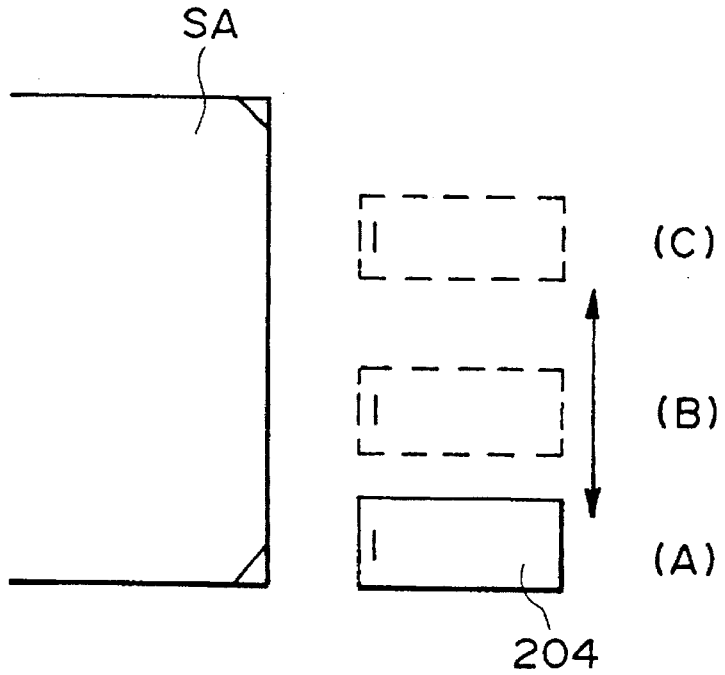
FIG. 26(a) PRIOR ART
FIGS. 26(*a*) and (*b*) are a schematic plan view depicting how the stapler or staplers are set in the conventional sorter which offers various binding methods.
Figure 26B:
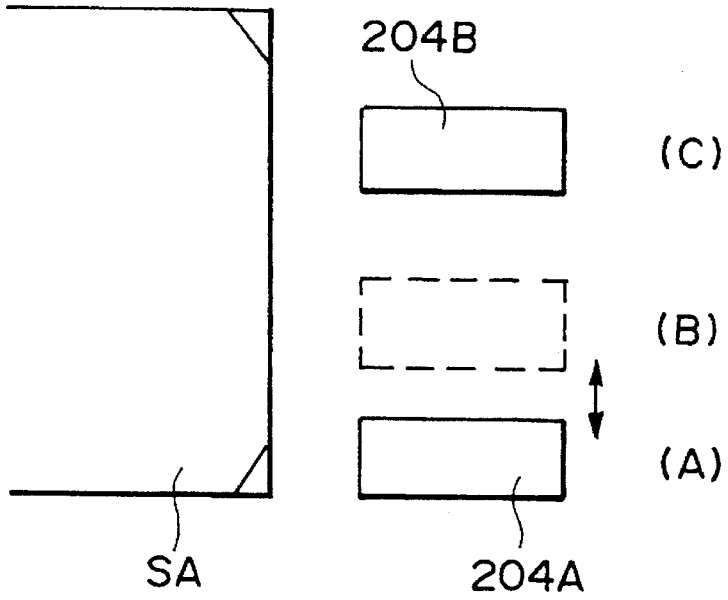
FIG. 26(b) PRIOR ART
Figure 27:
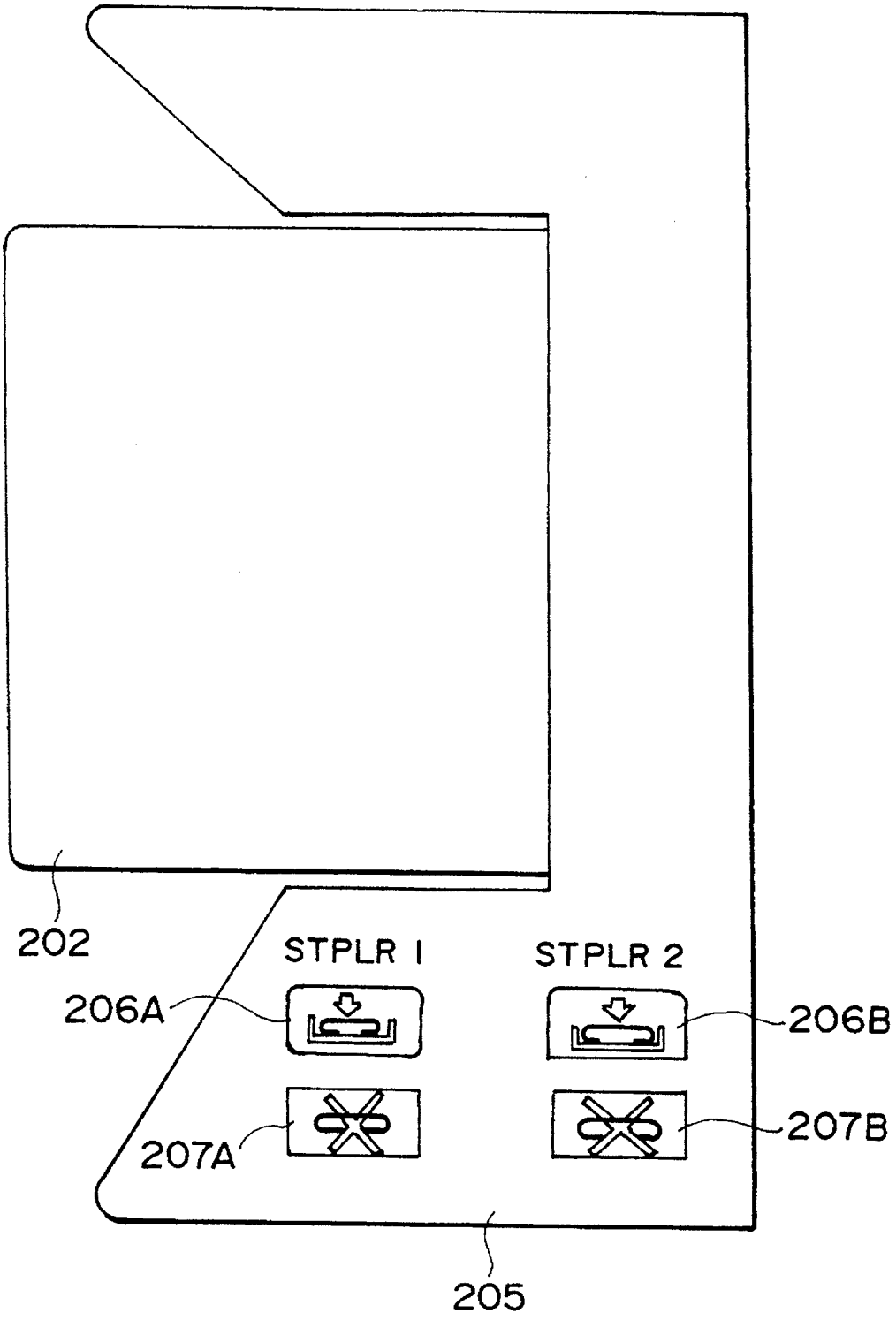
FIG. 27 PRIOR ART
FIG. 27 is a plan view of the out-of-staples display portion for displaying the out-of-staples condition, and staple jam display portion for displaying the staple jam condition of the conventional moving-bin type sorter.

FIG. 22 shows an example of the image forming apparatus (copying machine) comprising the moving-bin type sorter.

The main assembly of the image forming apparatus 900 comprises an original accommodating table 906, a light source 907, a lens system 908, a sheet feeding portion 909, an image forming portion 902, and the like.

The sheet feeding portion 909 comprises: cassettes 910 and 911, which store the sheet S and can be removably installed into the image forming apparatus 900 main assembly; and a deck 913 disposed on a pedestal 912.

Disposed within the image forming portion 902 are a cylindrical photosensitive member 914, a developing device 915 containing the toner, a transfer charger 916, a separator charger 917, a cleaner 918, a primary charger 919, and the like.

On the downstream side of the image forming portion 902, a conveying apparatus 920, a fixing apparatus 904, a discharging roller pair 905, and the like are disposed.

Next, the operation of this image forming apparatus will be described.

As a sheet feeding signal is outputted from an unillustrated controlling apparatus (CPU) provided on the main assembly side of the image forming apparatus 900, the sheet S is fed from one of the cassettes 910 or 911 or deck 913.

On the other hand, the light emitted from the light source 907 is irradiated onto an original D on the original accommodating table 906. The light reflected by the original D is projected onto the photosensitive member 914 through the lens system 908.

The photosensitive member 914 is charged in advance by the primary charger 919, and as the light is irradiated thereon, an electrostatic latent image is formed thereto. Then, a toner image is formed by the developing device 915.

The sheet S fed from the sheet feeding portion 909 is delivered to the registration roller pair 901, which aligns the sheet S if skewed, and sends it out to the image forming portion 902 with the correct timing.

In the image forming portion 902, the toner image is transferred by the transfer charger 916 Onto the sheet S sent into the image forming portion 902, and then, the sheet S having received the toner image is charged by the separator charger 917 to a polarity opposite to the polarity of the transfer charge, whereby the sheet S is separated from the photosensitive member 914.

The separated sheet S is conveyed to the fixing apparatus 904 by the conveying apparatus 920, and the transferred unfixed image is permanently fixed to the sheet S by this fixing apparatus 904.

The sheet S to which the image has been fixed is discharged from the image forming apparatus 900 main assembly by the discharge roller pair 905.

Thus, the sheet S fed from the sheet feeding portion 909 is discharged after an image is formed thereon.

In this specification, the moving-bin type sorter comprising a plurality of such staplers that bind the sheet set with the staples, but it is needless to say that the present invention is also similarly applicable to a post-image formation sheet processing apparatus comprising a plurality of post-image formation sheet processing means such as a hole puncher for punching binding holes in the sheet set.

Also, in this embodiment, only one case of the single point binding, that is, the one by the stapler 90*a* illustrated in FIG. 9, was described, but needless to say, the binding by the stapler 90*b* illustrated in FIG. 10 is also selectable. In the latter case, it is only necessary to replace the "stapler (2)" in the step S147 of the flow chart in FIG. 21, with the "stapler (1)."

While the invention has been described with reference to the structures disclosed herein, it is not confined to the details set forth and this application is intended to cover such modifications or changes as may come within the purposes of the improvements or the scope of the following claims.

What is claimed is:

1. A sheet post processing apparatus comprising:

a plurality of movable post-processing means for effecting a predetermined post-processing for a set of sheets;

malfunction detecting means for detecting malfunction for each of said post-processing means;

control means, responsive to said malfunction detecting means, for controlling said post-processing means to place, at a position where said post-processing means is to be placed if the malfunction did not occur, another one of said post-processing means free of the malfunction.

2. An apparatus according to claim 1, wherein said post-processing means includes a stapler for stapling the set of sheets, and said malfunction detecting means detects out-of-staple and staple as said malfunction.

3. An apparatus according to claim 1, further comprising common malfunction displaying means for displaying the malfunction detected by said detecting means, malfunction post-processing means displaying means for individually displaying the malfunction post-processing means detected by said detecting means, and a second control means for operating said malfunction displaying means and said malfunction post-processing means displaying means, wherein said malfunction displaying means is provided outside a main assembly of said apparatus, and malfunction post-processing means displaying means is provided in said apparatus.

4. An apparatus according to claim 3, wherein said malfunction displaying means is disposed at such a position as to be seen from the outside, and said malfunction post-processing means displaying means is disposed at such a position as to permit observation of said post-processing means inside thereof.

5. An apparatus according to claim 1, wherein two of such post-processing means are provided integrally with each other with a predetermined interval therebetween, and they are movable along a lateral edges of the sheet in the set.

6. An apparatus according to claim 1, further comprising sheet stacking means for stacking the sheets, wherein said post-processing means is movable in a direction substantially perpendicular to a discharge direction of the sheets.

7. An image forming apparatus comprising:

image forming means;

sheet stacking means for stacking sheets after formation of images by said image forming means;

a plurality of movable post-processing means for effecting a predetermined post-processing for the sheets stacked on said sheet stacking means;

malfunction detecting means for detecting malfunction for each of said post-processing means;

control means, responsive to said malfunction detecting means, for controlling said post-processing means to place, at a position where said post-processing means is to be placed if the malfunction did not occur, another one of said post-processing means free of the malfunction.

8. An apparatus according to claim 7, wherein said post-processing means includes a staple for stapling the set of sheets, and said malfunction detecting means detects out-of-staple and staple jam, as said malfunction.

9. An apparatus according to claim 7, further comprising common malfunction displaying means for displaying the malfunction detected by said detecting means, malfunction post-processing means displaying means for individually displaying the malfunction post-processing means detected by said detecting means, and a second control means for operating said malfunction displaying means and said malfunction post-processing means displaying means, wherein said malfunction displaying means is provided outside a main assembly of said apparatus, and malfunction post-processing means displaying means is provided in said apparatus.

10. A sheet post-processing apparatus comprising:

a plurality of movable post-processing means for effecting a predetermined post-processing for a set of sheets;

malfunction detecting means for detecting malfunction for each of said post-processing means;

common malfunction display means for displaying the malfunction detected by said detecting means;

malfunction post-processing means displaying means for individually displaying the malfunction post-processing means detected by said detecting means; and control means for operating said malfunction displaying means and said malfunction post-processing means displaying means;

wherein said malfunction displaying means is provided outside a main assembly of said apparatus, and malfunction post-processing means displaying means is provided in said apparatus.

11. An image forming means comprising:

image forming means;

sheet stacking means for stacking sheets after formation of images by said image forming means;

a plurality of movable post-processing means for effecting a predetermined post-processing for the sheets stacked on said sheet stacking means;

malfunction detecting means for detecting malfunction for each of said post-processing means;

common malfunction displaying means for displaying the malfunction detected by said detecting means;

malfunction post-processing means displaying means for individually displaying the malfunction post-processing means detected by said detecting means; and control means for operating said malfunction displaying means and said malfunction post-processing means displaying means;

wherein said malfunction displaying means is provided outside a main assembly of said apparatus, and malfunction post-processing means displaying means is provided in said apparatus.

* * * * *

UNITED STATES PATENT AND TRADEMARK OFFICE

CERTIFICATE OF CORRECTION

PATENT NO. : 5,573,233
DATED : November 12, 1996
INVENTOR(S) : HIRAI et al.

It is certified that error appears in the above-indentified patent and that said Letters Patent is hereby corrected as shown below:

COLUMN 2
Line 28, change "stapler.204" to --stapler 204--.

COLUMN 3
Line 41, change "is" to --it is--;
Line 42, change "set therefore," to --set SA; therefore--.

COLUMN 9
Line 1, change "set:" to --set;--.

COLUMN 12
Line 27, change "1;" to --it--.
Line 45, change "(8108, S119)," to --(S108, S119)--.
Line 59, delete "Abnormal S ituations".

COLUMN 13
Line 7, change "banding" to --binding--.

COLUMN 15
Line 16, change "staple" to --staple jam,--.

Signed and Sealed this

Sixth Day of May, 1997

*Attest:*

*Attesting Officer*

BRUCE LEHMAN

*Commissioner of Patents and Trademarks*